US010358800B2

(12) United States Patent
Kawaguchi et al.

(10) Patent No.: US 10,358,800 B2
(45) Date of Patent: Jul. 23, 2019

(54) CONTROL SYSTEM AND WORK MACHINE

(71) Applicant: Komatsu Ltd., Tokyo (JP)

(72) Inventors: Tadashi Kawaguchi, Tokyo (JP); Yuta Kamoshita, Tokyo (JP); Kenji Oshima, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 15/574,527

(22) PCT Filed: Apr. 24, 2017

(86) PCT No.: PCT/JP2017/016244
§ 371 (c)(1),
(2) Date: Nov. 16, 2017

(87) PCT Pub. No.: WO2017/188193
PCT Pub. Date: Nov. 2, 2017

(65) Prior Publication Data

US 2018/0305899 A1 Oct. 25, 2018

(51) Int. Cl.
*E02F 9/22* (2006.01)
*F02D 29/04* (2006.01)
(Continued)

(52) U.S. Cl.
CPC ..... *E02F 9/2246* (2013.01); *E02F 9/2239* (2013.01); *E02F 9/2292* (2013.01);
(Continued)

(58) Field of Classification Search
CPC ..... F11B 11/17; F11B 2211/365; F11B 2211/6313; F11B 2211/6323; E02F 9/2242; E02F 9/2246; E02F 9/2239; F02D 41/021; F15B 11/0423
See application file for complete search history.

(56) References Cited

U.S. PATENT DOCUMENTS 6,308,516 B1 10/2001 Kamada
7,520,130 B2 * 4/2009 Tanaka ..... F15B 11/17 60/421
(Continued)

FOREIGN PATENT DOCUMENTS

JP 11-336701 A 12/1999
JP 2009-150553 A 7/2009
(Continued)

OTHER PUBLICATIONS

International Search Report dated Jul. 25, 2017, issued for PCT/JP2017/016244.

*Primary Examiner* — Thomas E Lazo
*Assistant Examiner* — Abiy Teka
(74) *Attorney, Agent, or Firm* — Locke Lord LLP

(57) ABSTRACT

A control system includes: calculating a distribution flow rate of hydraulic fluid to be supplied to first and second hydraulic actuators based on a pressure of hydraulic fluid in the first and second hydraulic actuators and an operation amount operated to drive the first and second hydraulic actuators; calculating merged-state pump output indicating outputs of first and second hydraulic pumps required in a merged state based on the distribution flow rate; calculating separated-state pump output indicating outputs of the first and second hydraulic pumps required in the separated state based on the distribution flow rate; calculating excessive output of an engine based on the merged-state pump output and the separated-state pump output; calculating reduced output of the engine more reduced than target output by correcting the target output of the engine based on the excessive output; and controlling the engine based on the reduced output in the separated state.

9 Claims, 13 Drawing Sheets

(51) Int. Cl.

| | |
|---|---|
| ***F15B 11/17*** | (2006.01) |
| ***F15B 11/042*** | (2006.01) |
| ***F15B 11/16*** | (2006.01) |
| ***F02D 41/02*** | (2006.01) |

(52) U.S. Cl.

CPC ..... *E02F 9/2296* (2013.01); *F02D 29/04* (2013.01); *F02D 41/021* (2013.01); *F15B 11/0423* (2013.01); *F15B 11/165* (2013.01); *F15B 11/17* (2013.01); *F15B 2211/20515* (2013.01); *F15B 2211/20523* (2013.01); *F15B 2211/20546* (2013.01); *F15B 2211/20576* (2013.01); *F15B 2211/275* (2013.01); *F15B 2211/30595* (2013.01); *F15B 2211/40515* (2013.01); *F15B 2211/41518* (2013.01); *F15B 2211/6309* (2013.01); *F15B 2211/6313* (2013.01); *F15B 2211/6346* (2013.01); *F15B 2211/6651* (2013.01); *F15B 2211/6655* (2013.01); *F15B 2211/6658* (2013.01); *F15B 2211/7142* (2013.01)

(56) References Cited

U.S. PATENT DOCUMENTS

| | | | | |
|---|---|---|---|---|
| 7,992,384 | B2 * | 8/2011 | Itakura ..... | E02F 9/2228 60/421 |
| 9,394,671 | B2 * | 7/2016 | Hirozawa ..... | E02F 9/2217 |
| 2006/0230752 | A1 | 10/2006 | Sawada | |
| 2007/0125078 | A1 | 6/2007 | Tanaka et al. | |
| 2009/0057040 | A1 * | 3/2009 | Yamada ..... | B62D 11/001 180/6.48 |
| 2010/0281859 | A1 | 11/2010 | Oka | |
| 2015/0204054 | A1 | 7/2015 | Tsuruga et al. | |

FOREIGN PATENT DOCUMENTS

| | | | |
|---|---|---|---|
| WO | 2005/047709 | A1 | 5/2005 |
| WO | 2009/104313 | A1 | 8/2009 |
| WO | 2014/021015 | A1 | 2/2014 |

* cited by examiner

CONTROL SYSTEM AND WORK MACHINE

FIELD

The present invention relates to a control system and a work machine.

BACKGROUND

An excavator is known as a kind of work machine having a work unit. The work unit of the excavator is driven by a hydraulic cylinder. The hydraulic cylinder is actuated by hydraulic fluid discharged from a hydraulic pump. Patent Literature 1 discloses a hydraulic control device having a merging-separating valve that performs switching between a merged state in which hydraulic fluid discharged from a first hydraulic pump and hydraulic fluid discharged from a second hydraulic pump are merged and a separated state in which these two kinds of hydraulic fluid are not merged. In the separated state, a first hydraulic actuator is actuated by the hydraulic fluid discharged from the first hydraulic pump, and a second hydraulic actuator is actuated by the hydraulic fluid discharged from the second hydraulic pump.

CITATION LIST

Patent Literature

Patent Literature 1: WO 2005/047709 A1

SUMMARY

Technical Problem

Each of a first hydraulic pump and a second hydraulic pump is driven by an engine. For example, in the case where a load acting on a first hydraulic actuator is heavy in a separated state, a discharge pressure to discharge hydraulic fluid from the first hydraulic pump is needed to be increased by increasing output of the engine. However, in the case where there is no need to increase a discharge pressure of hydraulic fluid discharged from the second hydraulic pump in the separated state, the engine is to be unnecessarily driven with high output when the output of the engine is increased in order to increase the discharge pressure of the hydraulic fluid discharged from the first hydraulic pump. When the engine is unnecessarily driven with high output, improvement in fuel consumption of the engine is hindered.

An aspect of the present invention is directed to reducing fuel consumption of an engine that drives a first hydraulic pump and a second hydraulic pump.

Solution to Problem

According to an aspect of the present invention, a control system, comprises: an engine; a first hydraulic pump and a second hydraulic pump driven by the engine; a switching device provided in a flow path that connects the first hydraulic pump to the second hydraulic pump, and configured to perform switching between a merged state in which the flow path is opened and a separated state in which the flow path is closed; a first hydraulic actuator to which hydraulic fluid discharged from the first hydraulic pump is supplied in the separated state; a second hydraulic actuator to which hydraulic fluid discharged from the second hydraulic pump is supplied in the separated state; a distribution flow rate calculation unit configured to calculate a distribution flow rate of the hydraulic fluid to be supplied to each of the first hydraulic actuator and the second hydraulic actuator on the basis of a pressure of hydraulic fluid in each of the first hydraulic actuator and the second hydraulic actuator and an operation amount of an operation device operated in order to drive each of the first hydraulic actuator and the second hydraulic actuator; a merged-state pump output calculation unit configured to calculate merged-state pump output indicating output of the first hydraulic pump and output of the second hydraulic pump required in the merged state on the basis of the distribution flow rate; a separated-state pump output calculation unit configured to calculate separated-state pump output indicating output of the first hydraulic pump and output of the second hydraulic pump required in the separated state on the basis of the distribution flow rate; an excessive output calculation unit configured to calculate excessive output of the engine on the basis of the merged-state pump output and the separated-state pump output; a reduced output calculation unit configured to calculate reduced output of the engine more reduced than target output by correcting the target output of the engine on the basis of the excessive output; and an engine control unit configured to control the engine on the basis of the reduced output in the separated state.

Advantageous Effects of Invention

According to the aspect of the present invention, fuel consumption of the engine that drives the first hydraulic pump and the second hydraulic pump can be reduced.

DESCRIPTION OF EMBODIMENTS

In the following, an embodiment of the present invention will be described with reference to the drawings, but the present invention is not limited thereto. Note that components of each embodiment described in the following can be suitably combined. Additionally, there may be a case where some of the components are not used.

[Work Machine]

Figure 1:
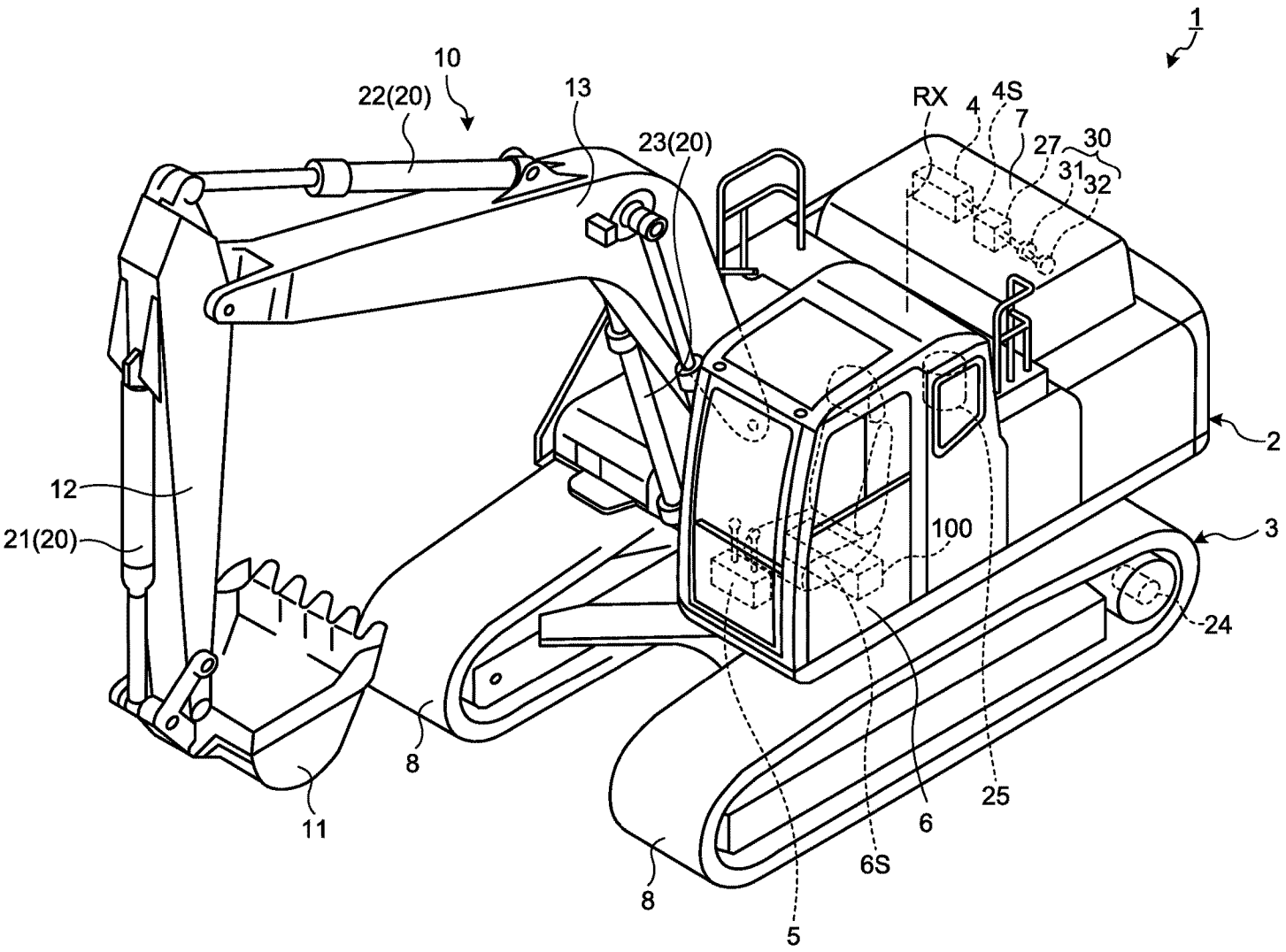
FIG. 1 is a perspective view illustrating an exemplary work machine according to the present embodiment.

FIG. 1 is a view illustrating an exemplary work machine 1 according to the present embodiment. In the present embodiment, it is assumed that a work machine 1 is an excavator of a hybrid system. In the following description, the work machine 1 will be referred to as an excavator 1 as appropriate.

As illustrated in FIG. 1, the excavator 1 includes a work unit 10, an upper swing body 2 that supports the work unit 10, a lower traveling body 3 that supports the upper swing body 2, an engine 4, a generator motor 27 driven by the engine 4, a hydraulic pump 30 driven by the engine 4, a hydraulic cylinder 20 that actuates the work unit 10, an electric motor 25 that swings the upper swing body 2, a hydraulic motor 24 that causes the lower traveling body 3 to travel, an operation device 5 to actuate the work unit 10, and a control device 100.

The engine 4 is a power source of the excavator 1. The engine 4 has an output shaft 4S connected to the generator motor 27 and the hydraulic pump 30. The engine 4 is, for example, a diesel engine. The engine 4 is housed in a machine room 7 of the upper swing body 2.

The generator motor 27 is connected to the output shaft 4S of the engine 4, and generates power by actuation of the engine 4. The generator motor 27 is, for example, a switched reluctance motor. Note that the generator motor 27 may also be a permanent magnet (PM) motor.

The hydraulic pump 30 is connected to the output shaft 4S of the engine 4, and discharges hydraulic fluid by actuation of the engine 4. In the present embodiment, the hydraulic pump 30 is connected to the output shaft 4S, and includes: a first hydraulic pump 31 driven by the engine 4; and a second hydraulic pump 32 connected to the output shaft 4S and driven by the engine 4. The hydraulic pump 30 is housed in the machine room 7 of the upper swing body 2.

The hydraulic cylinder 20 is actuated by hydraulic fluid supplied from the hydraulic pump 30. The hydraulic cylinder 20 is a hydraulic actuator that generates power to actuate the work unit 10. The work unit 10 can be actuated by the power generated by the hydraulic cylinder 20. The hydraulic cylinder 20 includes a bucket cylinder 21 to actuate a bucket 11, an arm cylinder 22 to actuate an arm 12, and a boom cylinder 23 to actuate a boom 13.

The electric motor 25 is actuated by power supplied from the generator motor 27. The electric motor 25 is an electric actuator that generates power to swing the upper swing body 2. The upper swing body 2 can swing about a swing shaft RX by the power generated by the electric motor 25.

The hydraulic motor 24 is actuated by hydraulic fluid supplied from the hydraulic pump 30. The hydraulic motor 24 is a hydraulic actuator that generates power to cause the lower traveling body 3 to travel. A crawler belt 8 of the lower traveling body 3 can be rotated by the power generated by the hydraulic motor 24.

The operation device 5 is arranged in an operating room 6. The operation device 5 includes an operating member to be operated by an operator of the excavator 1. The operating member includes an operating lever or a joystick. When the operation device 5 is operated, the work unit 10 is actuated.

[Control System]

Figure 2:
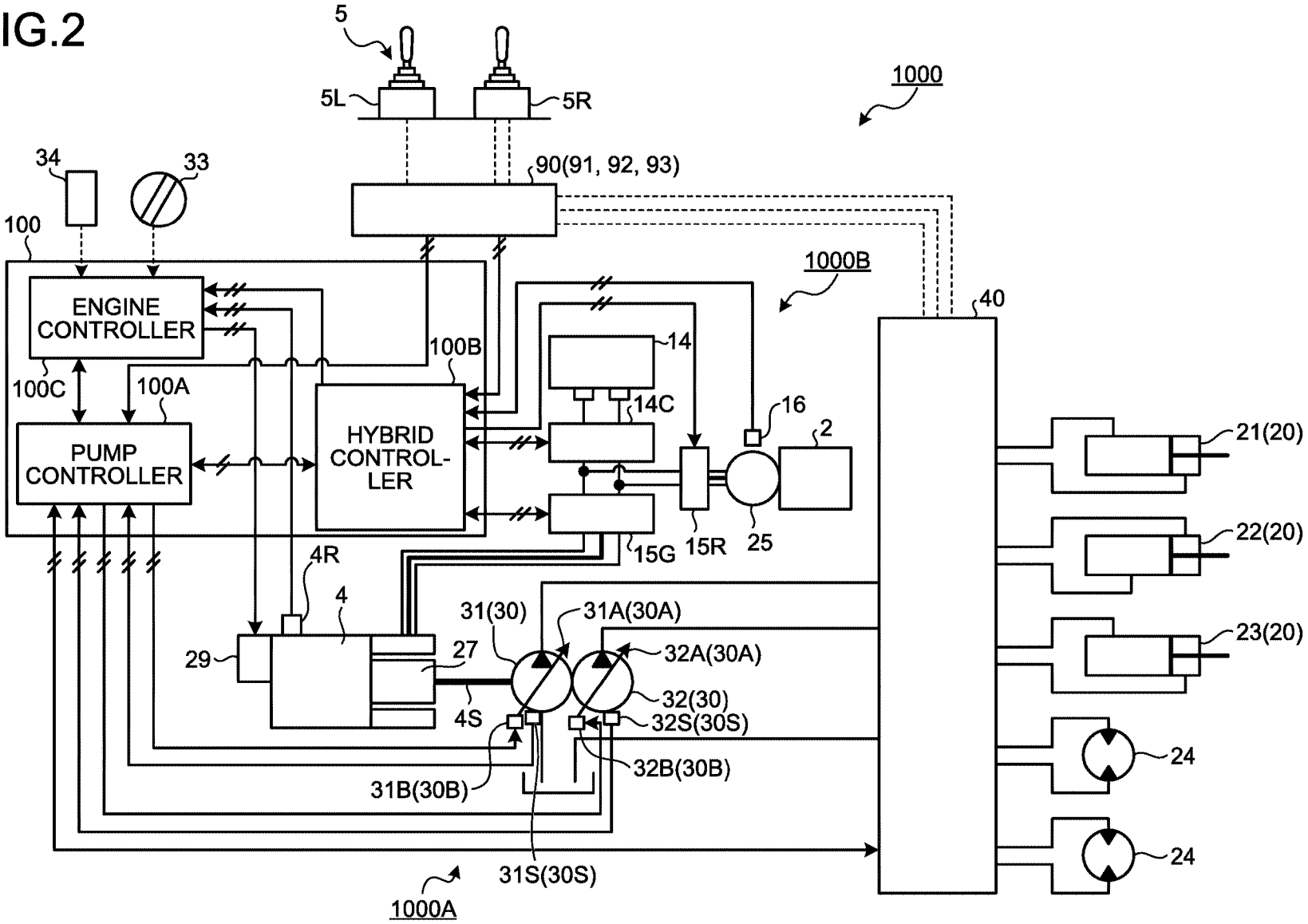
FIG. 2 is a diagram schematically illustrating an exemplary control system according to the present embodiment.

FIG. 2 is a diagram schematically illustrating an exemplary control system 1000 according to the present embodiment. The control system 1000 is mounted on the excavator 1 and controls the excavator 1. The control system 1000 includes a control device 100, a hydraulic system 1000A, and an electric system 1000B.

The hydraulic system 1000A has the hydraulic pump 30, a hydraulic circuit 40 in which hydraulic fluid discharged from the hydraulic pump 30 flows, the hydraulic cylinder 20 actuated by hydraulic fluid supplied from the hydraulic pump 30 via the hydraulic circuit 40, and the hydraulic motor 24 actuated by hydraulic fluid supplied from the hydraulic pump 30 via the hydraulic circuit 40.

The output shaft 4S of the engine 4 is connected to the hydraulic pump 30. When the engine 4 is driven, the hydraulic pump 30 is actuated. The hydraulic cylinder 20 and the hydraulic motor 24 are actuated on the basis of the hydraulic fluid discharged from the hydraulic pump 30. An engine speed sensor 4R that detects an engine speed [rpm] of the engine 4 is provided in the engine 4.

The hydraulic pump 30 is a variable displacement hydraulic pump. In the present embodiment, the hydraulic pump 30 is a swash plate hydraulic pump. A swash plate 30A of the hydraulic pump 30 is driven by a servo mechanism 30B. A capacity [cc/rev] of the hydraulic pump 30 is adjusted by adjusting an angle of the swash plate 30A by the servo mechanism 30B. The capacity of the hydraulic pump 30 represents a discharge amount [cc/rev] of the hydraulic fluid discharged from the hydraulic pump 30 when the output shaft 4S of the engine 4 connected to the hydraulic pump 30 is rotated once.

In the present embodiment, the swash plate 30A of the hydraulic pump 30 includes a swash plate 31A of the first hydraulic pump 31 and a swash plate 32A of the second hydraulic pump 32. The servo mechanism 30B includes: a servo mechanism 31B to adjust an angle of the swash plate 31A of the first hydraulic pump 31; and a servo mechanism 32B to adjust an angle of the swash plate 32A of the second hydraulic pump 32.

The electric system 1000B has the generator motor 27, a storage battery 14, a transformer 14C, a first inverter 15G, a second inverter 15R, and the electric motor 25 actuated by the power supplied from the generator motor 27.

The output shaft 4S of the engine 4 is connected to the generator motor 27. When the engine 4 is driven, the generator motor 27 is actuated. When the engine 4 is driven, a rotor of the generator motor 27 is rotated. When the rotor of the generator motor 27 is rotated, the generator motor 27 generates power. Meanwhile, the generator motor 27 may also be connected to the output shaft 4S of the engine 4 via a power transmission mechanism such as a power take off (PTO).

The electric motor 25 is actuated on the basis of power output from the generator motor 27. The electric motor 25 generates power to swing the upper swing body 2. A rotation sensor 16 is provided at the electric motor 25. The rotation sensor 16 includes, for example, a resolver or a rotary encoder. The rotation sensor 16 detects a rotation angle or a rotation speed of the electric motor 25.

The electric motor 25 generates regenerative energy during deceleration. The storage battery 14 includes, for example, an electric double layer storage battery and is charged with the regenerative energy generated by the electric motor 25. Note that the storage battery 14 may also be a secondary battery such as a nickel hydrogen battery or a lithium ion battery.

The operating room 6 is provided with the operation device 5, a throttle dial 33, and a work mode selector 34 which are operated by an operator.

The operation device 5 includes an operating member to operate the lower traveling body 3, an operating member to operate the upper swing body 2, and an operating member to operate the work unit 10. The hydraulic motor 24 that causes the lower traveling body 3 to travel is actuated on the basis of operation of the operation device 5. The electric motor 25 that swings the upper swing body 2 is actuated on the basis of operation of the operation device 5. The hydraulic cylinder 20 that actuates the work unit 10 is actuated on the basis of operation of the operation device 5.

In the present embodiment, the operation device 5 includes: a right operating lever 5R arranged on a right side of an operator seated on an operator's seat 6S; and a left operating lever 5L arranged on a left side thereof. When the right operating lever 5R is operated in a front-rear direction, the boom 13 performs lowering operation or raising operation. When the right operating lever 5R is operated in a right-left direction, the bucket 11 performs excavating operation or dumping operation. When the left operating lever 5L is operated in the front-rear direction, the arm 12 performs dumping operation or excavating operation. When the left operating lever 5L is operated in the right-left direction, the upper swing body 2 swings rightward or leftward. Meanwhile, when the left operating lever 5L is operated in the front-rear direction, the upper swing body 2 may swing rightward or leftward, and when the left operating lever 5L is operated in the right-left direction, the arm 12 may perform dumping operation or excavating operation.

The control system 1000 has an operation amount sensor 90 that detects an operation amount of the operation device 5. The operation amount sensor 90 includes: a bucket operation amount sensor 91 that detects an operation amount of the operation device 5 operated in order to drive the bucket cylinder 21 that actuates the bucket 11; an arm operation amount sensor 92 that detects an operation amount of the operation device 5 operated in order to drive the arm cylinder 22 that actuates the arm 12; and a boom operation amount sensor 93 that detects an operation amount of the operation device 5 operated in order to drive the boom cylinder 23 that actuates the boom 13.

The throttle dial 33 is an operating member to set a fuel injection amount to be injected to the engine 4. An upper limit engine speed Nmax [rpm] of the engine 4 is set by the throttle dial 33.

The work mode selector 34 is an operating member to set an output characteristic of the engine 4. Maximum output [kW] of the engine 4 is set by the work mode selector 34.

The control device 100 includes a computer system. The control device 100 has an arithmetic processing device including a processor such as a central processing unit (CPU), a storage device including a memory such as a read only memory (ROM) or a random access memory (RAM), and an input/output interface device. The control device 100 outputs command signals to control the hydraulic system 1000A and the electric system 1000B. In the present embodiment, the control device 100 includes a pump controller 100A to control the hydraulic system 1000A, a hybrid controller 100B to control the electric system 1000B, and an engine controller 1000 to control the engine 4.

The pump controller 100A outputs a command signal to control the first hydraulic pump 31 and the second hydraulic pump 32 on the basis of at least one of a command signal transmitted from the hybrid controller 100B, a command signal transmitted from the engine controller 100C, and a detection signal transmitted from the operation amount sensor 90.

In the present embodiment, the pump controller 100A outputs a command signal to adjust the capacity [cc/rev] of the hydraulic pump 30. The pump controller 100A adjusts the capacity [cc/rev] of the hydraulic pump 30 by outputting a command signal to the servo mechanism 30B and controlling the angle of the swash plate 30A of the hydraulic pump 30. The hydraulic pump 30 has a swash plate angle sensor 30S that detects the angle of the swash plate 30A. A detection signal of the swash plate angle sensor 30S is output to the pump controller 100A. The pump controller 100A controls the angle of the swash plate 30A by outputting a command signal to the servo mechanism 30B on the basis of the detection signal of the swash plate angle sensor 30S.

The hydraulic pump 30 is driven by the engine 4. When the engine speed [rpm] of the engine 4 is increased and the engine speed per unit time of the output shaft 4S of the engine 4 connected to the hydraulic pump 30 is increased, a discharge flow rate Q [l/min] of hydraulic fluid discharged from the hydraulic pump 30 per unit time is increased. When the engine speed [rpm] of the engine 4 is reduced and the engine speed per unit time of the output shaft 4S of the engine 4 connected to the hydraulic pump 30 is decreased, a discharge flow rate Q [l/min] of hydraulic fluid discharged from the hydraulic pump 30 per unit time is reduced.

When the engine 4 is driven at a maximum engine speed [rpm] in a state in which the hydraulic pump 30 is adjusted to a maximum capacity [cc/rev], the hydraulic pump 30 discharges hydraulic fluid at a maximum discharge flow rate Qmax [l/min].

In the present embodiment, the pump controller 100A outputs a command signal to adjust each of a capacity [cc/rev] of the first hydraulic pump 31 and a capacity [cc/rev] of the second hydraulic pump 32.

The pump controller 100A outputs a command signal to the servo mechanism 31B on the basis of a detection signal of the swash plate angle sensor 31S and controls the angle of the swash plate 31A of the first hydraulic pump 31, thereby adjusting the capacity [cc/rev] of the first hydraulic pump 31. The pump controller 100A outputs a command signal to the servo mechanism 32B on the basis of a detection signal of the swash plate angle sensor 32S and controls the angle of the swash plate 32A of the second hydraulic pump 32, thereby adjusting the capacity [cc/rev] of the second hydraulic pump 32.

The discharge flow rate Q [l/min] of the hydraulic fluid discharged from the hydraulic pump 30 includes: a discharge flow rate Q1 [l/min] of the hydraulic fluid discharged from the first hydraulic pump 31; and a discharge flow rate Q2 [l/min] of the hydraulic fluid discharged from the second hydraulic pump 32. When the engine speed of the engine 4 is increased and the engine speed per unit time of the output shaft 4S of the engine 4 connected to the first hydraulic pump 31 and the second hydraulic pump 32 is increased, the discharge flow rate Q1 [l/min] of the first hydraulic pump 31 and the discharge flow rate Q2 [l/min] of the second hydraulic pump 32 are increased. When the engine speed of the engine 4 is reduced and the engine speed per unit time of the output shaft 4S of the engine 4 connected to the first hydraulic pump 31 and the second hydraulic pump 32 is reduced, the discharge flow rate Q1 [l/min] of the first hydraulic pump 31 and the discharge flow rate Q2 [l/min] of the second hydraulic pump 32 are reduced.

The maximum discharge flow rate Qmax [l/min] of the hydraulic pump 30 includes: a maximum discharge flow rate Q1max [l/min] of the first hydraulic pump 31; and a maximum discharge flow rate Q2max [l/min] of the second hydraulic pump 32. When the engine 4 is driven at the maximum engine speed in a state in which the first hydraulic pump 31 is adjusted to the maximum capacity [cc/rev], the first hydraulic pump 31 discharges hydraulic fluid at the maximum discharge flow rate Q1max. Similarly, when the engine 4 is driven at the maximum engine speed in a state in which the second hydraulic pump 32 is adjusted to the maximum capacity [cc/rev], the second hydraulic pump 32 discharges the hydraulic fluid at the maximum discharge flow rate Q2max. In the present embodiment, the maximum discharge flow rate Q1max and the maximum discharge flow rate Q2max are equal.

The hybrid controller 100B controls the electric motor 25 on the basis of a detection signal of the rotation sensor 16. The electric motor 25 is actuated on the basis of power supplied from the generator motor 27 or the storage battery 14. In the present embodiment, the hybrid controller 100B performs: control for power transfer among the transformer 14C, the first inverter 15G, and the second inverter 15R; and control for power transfer between the transformer 14C and the storage battery 14.

Furthermore, the hybrid controller 100B controls the generator motor 27, electric motor 25, storage battery 14, first inverter 15G, and second inverter 15R on the basis of a detection signal of a temperature sensor provided in each of the generator motor 27, electric motor 25, storage battery 14, first inverter 15G, and second inverter 15R. Additionally, the hybrid controller 100B performs: control for charge/discharge of the storage battery 14; control for the generator motor 27; and assist control for the engine 4 by the generator motor 27.

The engine controller 100C generates a command signal on the basis of a setting value of the throttle dial 33 and outputs the same to a common rail control unit 29 provided in the engine 4. The common rail control unit 29 adjusts a fuel injection amount to the engine 4 on the basis of a command signal transmitted from the engine controller 100C.

[Hydraulic System]

Figure 3:
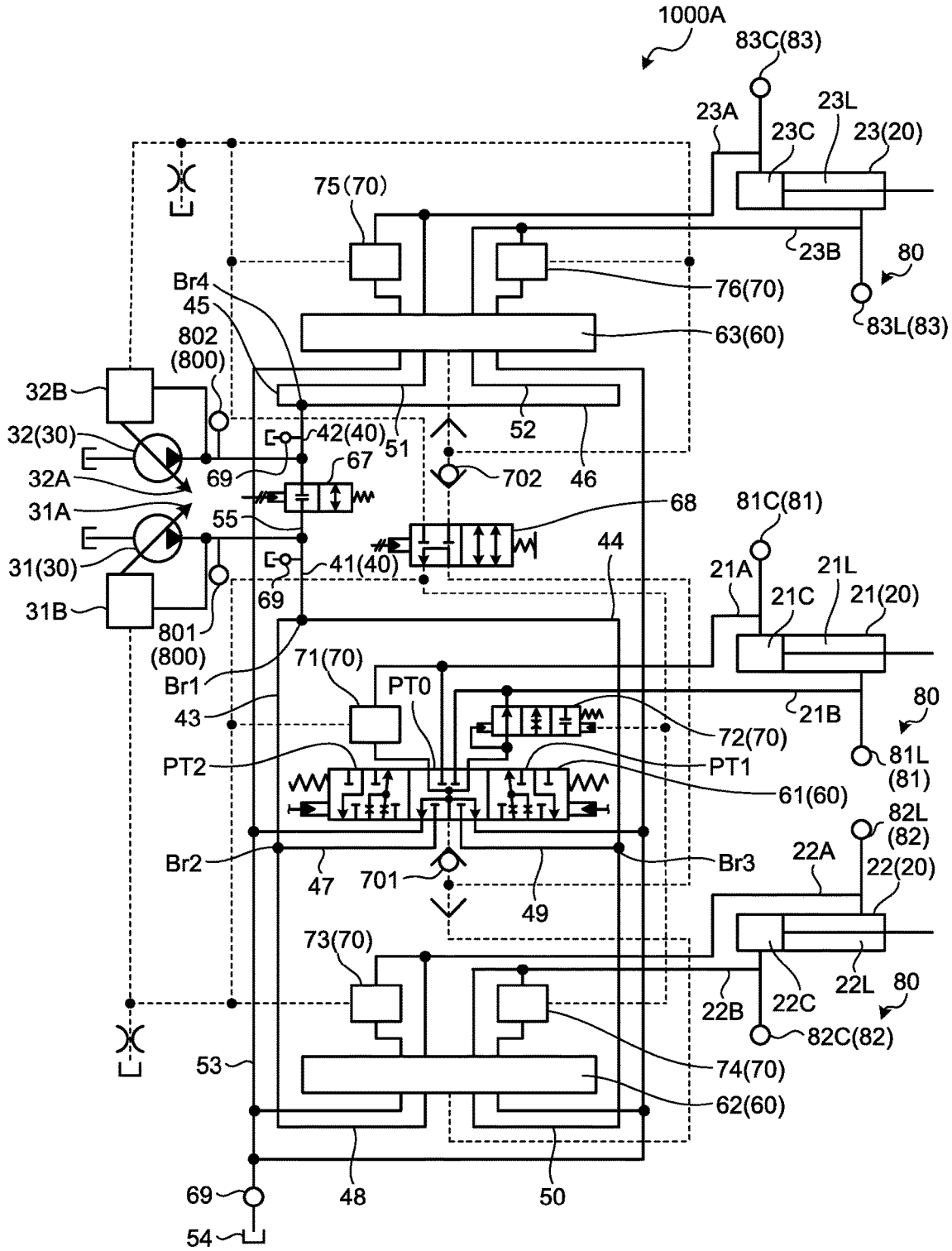
FIG. 3 is a diagram illustrating an exemplary hydraulic system according to the present embodiment.

FIG. 3 is a diagram illustrating an example of the hydraulic system 1000A according to the present embodiment. The hydraulic system 1000A includes: the hydraulic pump 30 that discharges hydraulic fluid; the hydraulic circuit 40 in which hydraulic fluid discharged from the hydraulic pump 30 flows; the hydraulic cylinder 20 to which the hydraulic fluid discharged from the hydraulic pump 30 is supplied via the hydraulic circuit 40; a main operation valve 60 that adjusts a direction of hydraulic fluid supplied to the hydraulic cylinder 20 and a distribution flow rate Qa of the hydraulic fluid; and a pressure compensating valve 70.

The hydraulic pump 30 includes the first hydraulic pump 31 and the second hydraulic pump 32. The hydraulic cylinder 20 includes the bucket cylinder 21, arm cylinder 22, and boom cylinder 23.

The main operation valve 60 includes: a first main operation valve 61 that adjusts a direction of hydraulic fluid supplied from the hydraulic pump 30 to the bucket cylinder 21 and a distribution flow rate Qabk of the hydraulic fluid; a second main operation valve 62 that adjusts a direction of hydraulic fluid supplied from the hydraulic pump 30 to the arm cylinder 22 and a distribution flow rate Qaar of the hydraulic fluid; and a third main operation valve 63 that adjusts a direction of hydraulic fluid supplied from the hydraulic pump 30 to the boom cylinder 23 and a distribution flow rate Qabm of the hydraulic fluid. The main operation valve 60 is a direction control valve of a slide spool system.

The pressure compensating valve 70 includes a pressure compensating valve 71, a pressure compensating valve 72, a pressure compensating valve 73, a pressure compensating valve 74, a pressure compensating valve 75, and a pressure compensating valve 76.

Additionally, the hydraulic system 1000A includes a first merging-separating valve 67 that is a switching device provided in a merging flow path 55 that connects the first hydraulic pump 31 to the second hydraulic pump 32, and capable of performing switching between a merged state in which the merging flow path 55 is opened and a separated state in which the merging flow path 55 is closed.

The hydraulic circuit 40 has: a first hydraulic pump flow path 41 connected to the first hydraulic pump 31; and a second hydraulic pump flow path 42 connected to the second hydraulic pump 32.

The hydraulic circuit 40 has: a first supply flow path 43 and a second supply flow path 44 which are connected to the first hydraulic pump flow path 41; and a third supply flow path 45 and a fourth supply flow path 46 which are connected to the second hydraulic pump flow path 42.

The first hydraulic pump flow path 41 is branched into the first supply flow path 43 and the second supply flow path 44 at a first branch portion Br1. The second hydraulic pump flow path 42 is branched into the third supply flow path 45 and the fourth supply flow path 46 at a fourth branch portion Br4.

The hydraulic circuit 40 has: a first branch flow path 47 and a second branch flow path 48 which are connected to the first supply flow path 43; and a third branch flow path 49 and a fourth branch flow path 50 which are connected to the second supply flow path 44. The first supply flow path 43 is branched into the first branch flow path 47 and the second branch flow path 48 at a second branch portion Br2. The second supply flow path 44 is branched into the third branch flow path 49 and the fourth branch flow path 50 at a third branch portion Br3.

The hydraulic circuit 40 has: a fifth branch flow path 51 connected to the third supply flow path 45; and a sixth branch flow path 52 connected to the fourth supply flow path 46.

The first main operation valve 61 is connected to the first branch flow path 47 and the third branch flow path 49. The second main operation valve 62 is connected to the second branch flow path 48 and the fourth branch flow path 50. The third main operation valve 63 is connected to the fifth branch flow path 51 and the sixth branch flow path 52.

The hydraulic circuit 40 has: a first bucket flow path 21A that connects the first main operation valve 61 to a cap-side space 21C of the bucket cylinder 21; and a second bucket flow path 21B that connects the first main operation valve 61 to a rod-side space 21L of the bucket cylinder 21.

The hydraulic circuit 40 has: a first arm flow path 22A that connects the second main operation valve 62 to a rod-side space 22L of the arm cylinder 22; and a second arm flow path 22B that connects the second main operation valve 62 to a cap-side space 22C of the arm cylinder 22.

The hydraulic circuit 40 has: a first boom flow path 23A that connects the third main operation valve 63 to a cap-side space 23C of the boom cylinder 23; and a second boom flow path 23B that connects the third main operation valve 63 to a rod-side space 23L of the boom cylinder 23.

The cap-side space of the hydraulic cylinder 20 is a space between a cylinder head cover and a piston. The rod-side space of the hydraulic cylinder 20 is a space in which a piston rod is arranged.

When hydraulic fluid is supplied to the cap-side space 21C of the bucket cylinder 21 and the bucket cylinder 21 is extended, the bucket 11 performs excavating operation. When hydraulic fluid is supplied to the rod-side space 21L of the bucket cylinder 21 and the bucket cylinder 21 is retracted, the bucket 11 performs dumping operation.

When hydraulic fluid is supplied to the cap-side space 22C of the arm cylinder 22 and the arm cylinder 22 is extended, the arm 12 performs excavating operation. When hydraulic fluid is supplied to the rod-side space 22L of the arm cylinder 22 and the arm cylinder 22 is retracted, the arm 12 performs dumping operation.

When hydraulic fluid is supplied to the cap-side space 23C of the boom cylinder 23 and the boom cylinder 23 is extended, the boom 13 performs lifting operation. When hydraulic fluid is supplied to the rod-side space 23L of the boom cylinder 23 and the boom cylinder 23 is retracted, the boom 13 performs lowering operation.

The first main operation valve 61 supplies hydraulic fluid to the bucket cylinder 21 and recovers hydraulic fluid discharged from the bucket cylinder 21. A spool of the first main operation valve 61 is movable to: a stop position PT0 whereby supply of hydraulic fluid to the bucket cylinder 21 is stopped to stop the bucket cylinder 21; a first position PT1 whereby the first branch flow path 47 and the first bucket flow path 21A are connected such that hydraulic fluid is supplied to the cap-side space 21C and the bucket cylinder 21 is extended; and a second position PT2 whereby the third branch flow path 49 and the second bucket flow path 21B are connected such that hydraulic fluid is supplied to the rod-side space 21L and the bucket cylinder 21 is retracted. The first main operation valve 61 is operated such that the bucket cylinder 21 becomes at least one of a stopped state, an extended state, and a retracted state.

The second main operation valve 62 supplies hydraulic fluid to the arm cylinder 22 and recovers hydraulic fluid discharged from the arm cylinder 22. The second main operation valve 62 has a structure similar to that of the first main operation valve 61. A spool of the second main operation valve 62 is movable to: a stop position whereby supply of hydraulic fluid to the arm cylinder 22 is stopped to stop the arm cylinder 22; a second position whereby the fourth branch flow path 50 and the second arm flow path 22B are connected such that hydraulic fluid is supplied to the cap-side space 22C and the arm cylinder 22 is extended; and a first position whereby the second branch flow path 48 and the first arm flow path 22A are connected such that hydraulic fluid is supplied to the rod-side space 22L and the arm cylinder 22 is retracted. The second main operation valve 62 is operated such that the arm cylinder 22 becomes at least one of a stopped state, an extended state, and a retracted state.

The third main operation valve 63 supplies hydraulic fluid to the boom cylinder 23 and recovers hydraulic fluid discharged from the boom cylinder 23. The third main operation valve 63 has a structure similar to that of the first main operation valve 61. A spool of the third main operation valve 63 is movable to: a stop position whereby supply of hydraulic fluid to the boom cylinder 23 is stopped to stop the boom cylinder 23; a first position whereby the fifth branch flow path 51 and the first boom flow path 23A are connected such that hydraulic fluid is supplied to the cap-side space 23C and the boom cylinder 23 is extended; and a second position whereby the sixth branch flow path 52 and the second boom flow path 23B are connected such that hydraulic fluid is supplied to the rod-side space 23L and the boom cylinder 23 is retracted. The third main operation valve 63 is operated such that the boom cylinder 23 becomes at least one of a stopped state, an extended state, and a retracted state.

The first main operation valve 61 is operated by the operation device 5. When the operation device 5 is operated, a pilot pressure determined on the basis of an operation amount of the operation device 5 acts on the first main operation valve 61. When the pilot pressure acts on the first main operation valve 61, a direction of hydraulic fluid supplied from the first main operation valve 61 to the bucket cylinder 21 and a distribution flow rate Qabk of the hydraulic fluid are determined. A rod of the bucket cylinder 21 is moved in a moving direction corresponding to the direction of the supplied hydraulic fluid, and actuated at a cylinder speed corresponding to the distribution flow rate Qabk of the supplied hydraulic fluid. When the bucket cylinder 21 is actuated, the bucket 11 is actuated on the basis of the moving direction and the cylinder speed of the bucket cylinder 21.

Similarly, the second main operation valve 62 is operated by the operation device 5. When the operation device 5 is operated, a pilot pressure determined on the basis of an operation amount of the operation device 5 acts on the second main operation valve 62. When the pilot pressure acts on the second main operation valve 62, a direction of hydraulic fluid supplied from the second main operation valve 62 to the arm cylinder 22 and a distribution flow rate Qaar of the hydraulic fluid are determined. A rod of the arm cylinder 22 is moved in a moving direction corresponding to the direction of the supplied hydraulic fluid, and actuated at a cylinder speed corresponding to the distribution flow rate Qaar of the supplied hydraulic fluid. When the arm cylinder 22 is actuated, the arm 12 is actuated on the basis of the moving direction and the cylinder speed of the arm cylinder 22.

Similarly, the third main operation valve 63 is operated by the operation device 5. When the operation device 5 is operated, a pilot pressure determined on the basis of an operation amount of the operation device 5 acts on the third main operation valve 63. When the pilot pressure acts on the third main operation valve 63, a direction of hydraulic fluid supplied from the third main operation valve 63 to the boom cylinder 23 and a distribution flow rate Qabm of the hydraulic fluid are determined. A rod of the boom cylinder 23 is moved in a moving direction corresponding to the direction of the supplied hydraulic fluid, and actuated at a cylinder speed corresponding to the distribution flow rate Qabm of the supplied hydraulic fluid. When the boom cylinder 23 is actuated, the boom 13 is actuated on the basis of the moving direction and the cylinder speed of the boom cylinder 23.

The hydraulic fluid discharged from each of the bucket cylinder 21, arm cylinder 22, and boom cylinder 23 is recovered in a tank 54 via a discharge flow path 53.

The first hydraulic pump flow path 41 and the second hydraulic pump flow path 42 are connected by the merging flow path 55. The merging flow path 55 is a flow path that connects the first hydraulic pump 31 to the second hydraulic pump 32. The merging flow path 55 connects the first hydraulic pump 31 to the second hydraulic pump 32 via the first hydraulic pump flow path 41 and the second hydraulic pump flow path 42.

The first merging-separating valve 67 is a switching device to open and close the merging flow path 55. The first merging-separating valve 67 performs switching between a merged state in which the merging flow path 55 is opened and a separated state in which the merging flow path 55 is closed by opening and closing the merging flow path 55. In the present embodiment, the first merging-separating valve 67 is a switching valve. Note that as far as the merging flow path 55 can be opened and closed, the switching device that opens and closes the merging flow path 55 may not necessarily be the switching valve.

A spool of the first merging-separating valve 67 is movable to: a merging position whereby the first hydraulic pump flow path 41 and the second hydraulic pump flow path 42 are connected by opening the merging flow path 55; and a separating position whereby the first hydraulic pump flow path 41 and the second hydraulic pump flow path 42 are separated by closing the merging flow path 55. The control device 100 controls the first merging-separating valve 67 such that the first hydraulic pump flow path 41 and the second hydraulic pump flow path 42 to become any one of the merged state and the separated state.

The merged state represents a state in which: the first hydraulic pump flow path 41 and the second hydraulic pump flow path 42 are connected via the merging flow path 55 when the merging flow path 55 that connects the first hydraulic pump flow path 41 to the second hydraulic pump flow path 42 is opened by the first merging-separating valve 67; and hydraulic fluid discharged from the first hydraulic pump flow path 41 and hydraulic fluid discharged from the second hydraulic pump flow path 42 are merged at the first merging-separating valve 67. In the merged state, the hydraulic fluid discharged from both of the first hydraulic pump 31 and the second hydraulic pump 32 is supplied to each of the bucket cylinder 21, the arm cylinder 22, and the boom cylinder 23.

The separated state represents a state in which: the first hydraulic pump flow path 41 and the second hydraulic pump flow path 42 are separated from each other when the merging flow path 55 that connects the first hydraulic pump flow path 41 to the second hydraulic pump flow path 42 is closed by the first merging-separating valve 67; and the hydraulic fluid discharged from the first hydraulic pump flow path 41 and the hydraulic fluid discharged from the second hydraulic pump flow path 42 are separated. In the separated state, the hydraulic fluid discharged from the first hydraulic pump 31 is supplied to the bucket cylinder 21 and the arm cylinder 22, and the hydraulic fluid discharged from the second hydraulic pump 32 is supplied to the boom cylinder 23.

In other words, in the present embodiment, the first hydraulic actuator to which the hydraulic fluid discharged from the first hydraulic pump 31 is supplied in the separated state corresponds to the bucket cylinder 21 and the arm cylinder 22. The second hydraulic actuator to which the hydraulic fluid discharged from the second hydraulic pump 32 is supplied in the separated state corresponds to the boom cylinder 23. In the separated state, the hydraulic fluid discharged from the first hydraulic pump 31 is not supplied to the boom cylinder 23. In the separated state, the hydraulic fluid discharged from the second hydraulic pump 32 is not supplied to the bucket cylinder 21 and the arm cylinder 22.

In the merged state, the hydraulic fluid discharged from each of the first hydraulic pump 31 and the second hydraulic pump 32 passes through each of the first hydraulic pump flow path 41, second hydraulic pump flow path 42, first main operation valve 61, second main operation valve 62, and third main operation valve 63 and then is supplied to each of the bucket cylinder 21, arm cylinder 22, and boom cylinder 23.

In the separated state, the hydraulic fluid discharged from the first hydraulic pump 31 passes through the first hydraulic pump flow path 41, first main operation valve 61, and second main operation valve 62 and then is supplied to the bucket cylinder 21 and arm cylinder 22. Additionally, in the separated state, the hydraulic fluid discharged from the second hydraulic pump 32 passes through the second hydraulic pump flow path 42 and the third main operation valve 63 and then is supplied to the boom cylinder 23.

The hydraulic system 1000A has: a shuttle valve 701 provided between the first main operation valve 61 and the second main operation valve 62; and a shuttle valve 702 provided between a second merging-separating valve 68 and the third main operation valve 63. Additionally, the hydraulic system 1000A has the second merging-separating valve 68 connected to the shuttle valve 701 and the shuttle valve 702.

The second merging-separating valve 68 selects a maximum pressure of a load sensing pressure (LS pressure) obtained by reducing a pressure of hydraulic fluid supplied to each of the bucket cylinder 21, arm cylinder 22, and boom cylinder 23 by the shuttle valve 701 and the shuttle valve 702. The load sensing pressure is a pilot pressure used for pressure compensation.

When the second merging-separating valve 68 is in the merged state, the maximum LS pressure among those in the bucket cylinder 21 to the boom cylinder 23 is selected and supplied to the pressure compensating valve 70 in each of the bucket cylinder 21 to the boom cylinder 23 and also supplied to the servo mechanism 31B of the first hydraulic pump 31 and the servo mechanism 32B of the second hydraulic pump 32.

When the second merging-separating valve 68 is in the separated state, the maximum LS pressure in each of the bucket cylinder 21 and the arm cylinder 22 is supplied to the pressure compensating valve 70 in each of the bucket cylinder 21 and the arm cylinder 22 and the servo mechanism 31B of the first hydraulic pump 31, and the LS pressure of the boom cylinder 23 is supplied to the pressure compensating valve 70 of the boom cylinder 23 and the servo mechanism 32B of the second hydraulic pump 32.

The shuttle valve 701 and the shuttle valve 702 select a pilot pressure indicating a maximum value from among pilot pressures output from the first main operation valve 61, second main operation valve 62, and third main operation valve 63. The selected pilot pressure is supplied to the pressure compensating valve 70 and the servo mechanism (31B, 32B) of the hydraulic pump 30 (31, 32).

<Pressure Sensor>

The hydraulic system 1000A has a load pressure sensor 80 that detects a pressure PL of hydraulic fluid in the hydraulic cylinder 20. The pressure PL of the hydraulic fluid in the hydraulic cylinder 20 is a load pressure of hydraulic fluid supplied to the hydraulic cylinder 20. A detection signal of the load pressure sensor 80 is output to the control device 100.

In the present embodiment, the load pressure sensor 80 includes: a bucket load pressure sensor 81 that detects a pressure PLbk of hydraulic fluid in the bucket cylinder 21, an arm load pressure sensor 82 that detects a pressure PLar of hydraulic fluid in the arm cylinder 22, and a boom load pressure sensor 83 that detects a pressure PLbm of the hydraulic fluid in the boom cylinder 23.

The bucket load pressure sensor 81 includes: a bucket load pressure sensor 81C provided in the first bucket flow path 21A and detecting a pressure PLbkc of hydraulic fluid in the cap-side space 21C of the bucket cylinder 21; and a bucket load pressure sensor 81L provided in the second bucket flow path 21B and detecting a pressure PLbk1 of hydraulic fluid in the rod-side space 21L of the bucket cylinder 21.

The arm load pressure sensor 82 includes: an arm load pressure sensor 82C provided in the second arm flow path 22B and detecting a pressure PLarc of hydraulic fluid in the cap-side space 22C of the arm cylinder 22; and an arm load pressure sensor 82L provided in the first arm flow path 22A and detecting a pressure PLar1 of hydraulic fluid in the rod-side space 22L of the arm cylinder 22.

The boom load pressure sensor 83 includes: a boom load pressure sensor 83C provided in the first boom flow path 23A and detecting a pressure PLbmc of hydraulic fluid in the cap-side space 23C of the boom cylinder 23; and a boom load pressure sensor 83L provided in the second boom flow path 23B and detecting a pressure PLbm1 of hydraulic fluid in the rod-side space 23L of the boom cylinder 23.

Furthermore, the hydraulic system 1000A has a discharge pressure sensor 800 that detects a discharge pressure P of hydraulic fluid discharged from the hydraulic pump 30. A detection signal of the discharge pressure sensor 800 is output to the control device 100.

The discharge pressure sensor 800 includes: a discharge pressure sensor 801 provided between the first hydraulic pump 31 and the first hydraulic pump flow path 41 and detecting a discharge pressure P1 of hydraulic fluid discharged from the first hydraulic pump 31; and a discharge pressure sensor 802 provided between the second hydraulic pump 32 and the second hydraulic pump flow path 42 and detecting a discharge pressure P2 of hydraulic fluid discharged from the second hydraulic pump 32.

<Pressure Compensating Valve>

The pressure compensating valve 70 has a selection port to make a selection from among communicating, throttling, and blocking. The pressure compensating valve 70 includes a throttle valve that enables switching between blocking, throttling, and communicating by self-pressure. The pressure compensating valve 70 is directed to compensating flow rate distribution in accordance with a ratio of a metering opening area of each main operation valve 60 even when a load pressure of each hydraulic cylinder 20 is different. In the case of having no pressure compensating valve 70, most of hydraulic fluid flows into the hydraulic cylinder 20 on a low load side. The pressure compensating valve 70 implements a function of flow rate distribution because an outlet pressure of each main operation valve 60 is made uniform by making a pressure loss act on the hydraulic cylinder 20 having a low load pressure such that an outlet pressure of the main operation valve 60 of the hydraulic cylinder 20 having the low load pressure becomes equivalent to an outlet pressure of the main operation valve 60 of the hydraulic cylinder 20 having a maximum load pressure.

The pressure compensating valve 70 includes a pressure compensating valve 71 and a pressure compensating valve 72 which are connected to the first main operation valve 61, a pressure compensating valve 73 and a pressure compensating valve 74 which are connected to the second main operation valve 62, a pressure compensating valve 75 and a pressure compensating valve 76 which are connected to the third main operation valve 63.

The pressure compensating valve 71 compensates a differential pressure (metering differential pressure) between before and after the first main operation valve 61 in a state in which the first branch flow path 47 and the first bucket flow path 21A are connected such that hydraulic fluid is supplied to the cap-side space 21C. The pressure compensating valve 72 compensates a differential pressure (metering differential pressure) between before and after the first main operation valve 61 in a state in which the third branch flow path 49 and the second bucket flow path 21B are connected such that hydraulic fluid is supplied to the rod-side space 21L.

The pressure compensating valve 73 compensates a differential pressure (metering differential pressure) between before and after the second main operation valve 62 in a state in which the second branch flow path 48 and the first arm flow path 22A are connected such that hydraulic fluid is supplied to the rod-side space 22L. The pressure compensating valve 74 compensates a differential pressure (metering differential pressure) between before and after the second main operation valve 62 in a state in which the fourth branch flow path 50 and the second arm flow path 22B are connected such that hydraulic fluid is supplied to the cap-side space 22C.

Meanwhile, the differential pressure (metering differential pressure) between before and after the main operation valve 60 represents a difference between a pressure at an inlet port corresponding to the hydraulic pump 30 side of the main operation valve 60 and a pressure at an outlet port corresponding to the hydraulic cylinder 20 side, and corresponds to a differential pressure to measure a flow rate (metering).

Using the pressure compensating valve 70, hydraulic fluid can be distributed to each of the bucket cylinder 21 and the arm cylinder 22 at a flow rate according to an operation amount of the operation device 5 even in the case where a light load acts on the hydraulic cylinder 20 corresponding to one of the bucket cylinder 21 and the arm cylinder 22 and a heavy load acts on the hydraulic cylinder 20 corresponding to the other thereof.

The pressure compensating valve 70 enables supply at a flow rate based on operation regardless of loads acting on the plurality of hydraulic cylinders 20. For example, in the case where a heavy load acts on the bucket cylinder 21 while a light load acts on the arm cylinder 22, the pressure compensating valve 70 (73, 74) arranged on the light load side compensates a metering differential pressure ΔP2 on the arm cylinder 22 side, namely, the light load side so as to become substantially a pressure equal to a metering differential pressure ΔP1 on the bucket cylinder 21 side such that supply is performed at a flow rate based on an operation amount of the second main operation valve 62 when hydraulic fluid is supplied from the second main operation valve 62 to the arm cylinder 22, regardless of the metering differential pressure ΔP1 generated by hydraulic fluid is supplied from the first main operation valve 61 to the bucket cylinder 21.

In the case where a heavy load acts on the arm cylinder 22 while a light load acts on the bucket cylinder 21, the pressure compensating valve 70 (71, 72) arranged on the light load side compensates the metering differential pressure ΔP1 on the light load side such that supply is performed at a flow rate based on an operation amount of the first main operation valve 61 when hydraulic fluid is supplied from the first main operation valve 61 to the bucket cylinder 21, regardless of the metering differential pressure ΔP2 generated by hydraulic fluid being supplied from the second main operation valve 62 to the arm cylinder 22.

<Unload Valve>

The hydraulic circuit 40 has an unloading valve 69. In the hydraulic circuit 40, even when the hydraulic cylinder 20 is not driven, hydraulic fluid at a flow rate corresponding to a minimum capacity is discharged from the hydraulic pump 30. When the hydraulic cylinder 20 is not driven, the hydraulic fluid discharged from the hydraulic pump 30 is discharged (unloaded) via the unloading valve 69.

[Control Device]

Figure 4:
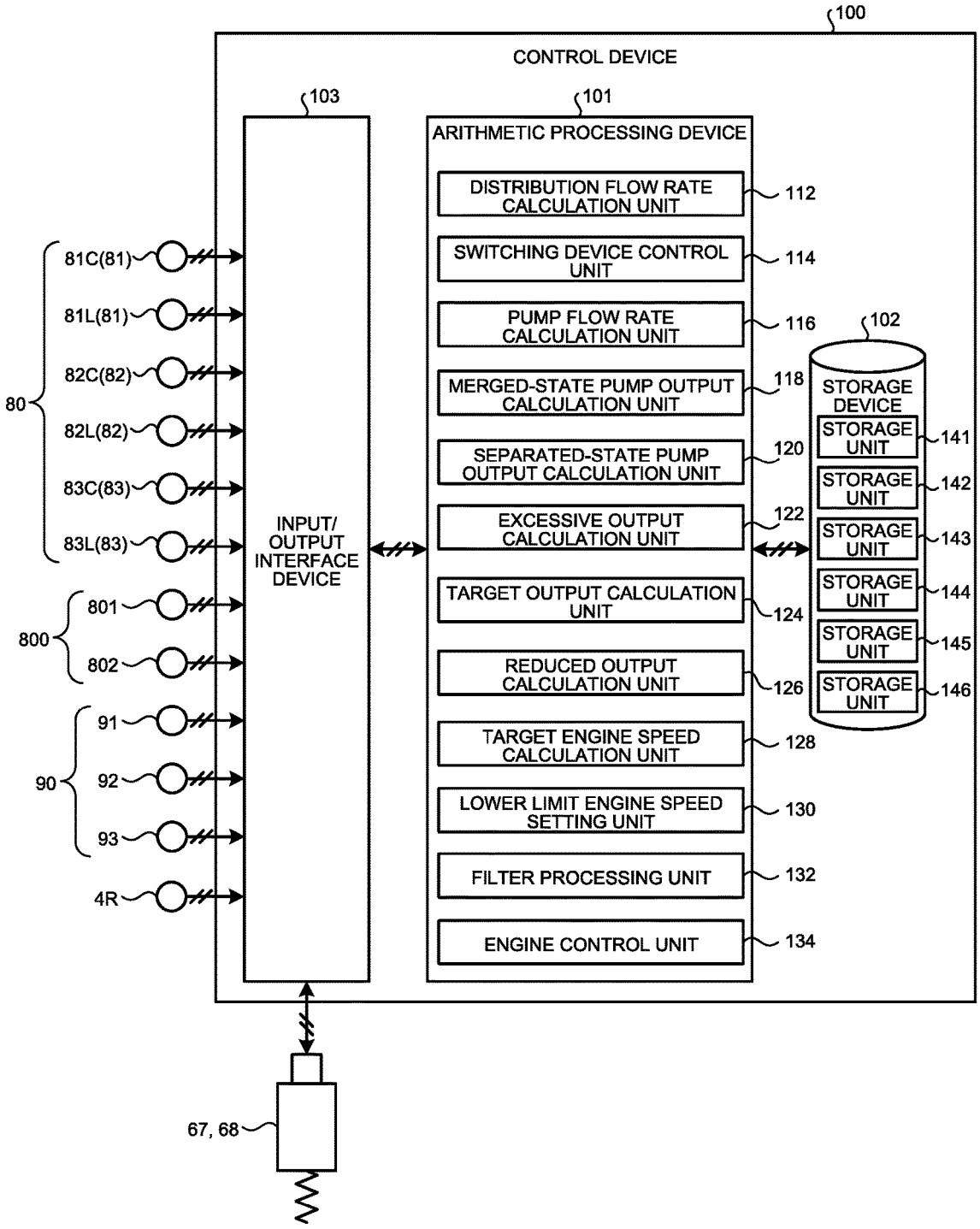
FIG. 4 is a functional block diagram illustrating an exemplary control device according to the present embodiment.

FIG. 4 is a functional block diagram illustrating an example of the control device 100 according to the present embodiment. The control device 100 includes a computer system. The control device 100 has an arithmetic processing device 101, a storage device 102, and an input/output interface device 103.

The control device 100 is connected to the first merging-separating valve 67 and the second merging-separating valve 68, and outputs command signals to the first merging-separating valve 67 and the second merging-separating valve 68.

Additionally, the control device 100 is connected to each of the load pressure sensor 80 that detects a pressure PL of the hydraulic cylinder 20, the discharge pressure sensor 800 that detects a discharge pressure P of hydraulic fluid discharged from the hydraulic pump 30, and the operation amount sensor 90 that detects an operation amount S of an operation device 5.

In the present embodiment, the operation amount sensor 90 (91, 92, 93) is a pressure sensor. When the operation device 5 is operated in order to drive the bucket cylinder 21, a pilot pressure acting on the first main operation valve 61 is changed on the basis of an operation amount Sbk of the operation device 5. Furthermore, when the operation device 5 is operated in order to drive the arm cylinder 22, a pilot pressure acting on the second main operation valve 62 is changed on the basis of an operation amount Sar of the operation device 5. Additionally, when the operation device 5 is operated in order to drive the boom cylinder 23, a pilot pressure acting on the third main operation valve 63 is changed on the basis of an operation amount Sbm of the operation device 5. The bucket operation amount sensor 91 detects the pilot pressure acting on the first main operation valve 61 when the operation device 5 is operated in order to drive the bucket cylinder 21. The arm operation amount sensor 92 detects the pilot pressure acting on the second main operation valve 62 when the operation device 5 is operated in order to drive the arm cylinder 22. The boom operation amount sensor 93 detects the pilot pressure acting on the third main operation valve 63 when the operation device 5 is operated in order to drive the boom cylinder 23.

The arithmetic processing device 101 has a distribution flow rate calculation unit 112, a switching device control unit 114, a pump flow rate calculation unit 116, a merged-state pump output calculation unit 118, a separated-state pump output calculation unit 120, an excessive output calculation unit 122, a target output calculation unit 124, a reduced output calculation unit 126, a target engine speed calculation unit 128, a lower limit engine speed setting unit 130, a filter processing unit 132, and an engine control unit 134.

The storage device 102 has a storage unit 141 to store first correlation data, a storage unit 142 to store second correlation data, a storage unit 143 to store third correlation data, a storage unit 144 to store fourth correlation data, a storage unit 145 to store fifth correlation data, and a storage unit 146 to store other various kinds of data.

<Distribution Flow Rate Calculation Unit>

The distribution flow rate calculation unit 112 calculates a distribution flow rate Qa of hydraulic fluid supplied to each of the plurality of hydraulic cylinders 20 on the basis of a pressure PL of hydraulic fluid in each of the plurality of hydraulic cylinders 20 and an operation amount S of the operation device 5 operated in order to drive each of the plurality of hydraulic cylinders 20. In the present embodiment, the distribution flow rate calculation unit 112 calculates the distribution flow rate Qa on the basis of the pressure PL of hydraulic fluid in the hydraulic cylinder 20, the operation amount S of the operation device 5, and the discharge pressure P of hydraulic fluid discharged from the hydraulic pump 30.

The pressure PL of the hydraulic fluid of the hydraulic cylinder 20 is detected by the load pressure sensor 80. The distribution flow rate calculation unit 112 acquires the pressure PLbk of the hydraulic fluid in the bucket cylinder 21 from the bucket load pressure sensor 81, acquires the pressure PLar of the hydraulic fluid in the arm cylinder 22 from the arm load pressure sensor 82, and acquires the pressure PLbm of the hydraulic fluid in the boom cylinder 23 from the boom load pressure sensor 83.

The operation amount S of the operation device 5 is detected by the operation amount sensor 90. The distribution flow rate calculation unit 112 acquires the operation amount Sbk of the operation device 5 operated in order to drive the bucket cylinder 21 from the bucket operation amount sensor 91, acquires the operation amount Sar of the operation device 5 operated in order to drive the arm cylinder 22 from the arm operation amount sensor 92, and acquires the operation amount Sbm of the operation device 5 operated in order to drive the boom cylinder 23 from the boom operation amount sensor 93.

The discharge pressure P of the hydraulic fluid in the hydraulic pump 30 is detected by the discharge pressure sensor 800. The distribution flow rate calculation unit 112 acquires the discharge pressure P1 of the hydraulic fluid in the first hydraulic pump 31 from the discharge pressure sensor 801, and acquires the discharge pressure P2 of the hydraulic fluid in the second hydraulic pump 32 from the discharge pressure sensor 802.

The distribution flow rate calculation unit 112 calculates the distribution flow rate Qa (Qabk, Qaar, Qabm) of hydraulic fluid supplied to each of the plurality of hydraulic cylinder 20 (21, 22, 23) on the basis of the pressure PL (PLbk, PLar, PLbm) of the hydraulic fluid in each of the plurality of hydraulic cylinders 20 (21, 22, 23) and the operation amount S (Sbk, Sar, Sbm) of the operation device 5 operated in order to drive each of the plurality of hydraulic cylinders 20 (21, 22, 23).

The distribution flow rate calculation unit 112 calculates the distribution flow rate Qa on the basis of Expression (1).

$$Qa = Qd \times \sqrt{\{(P-PL)/\Delta PC\}} \quad (1)$$

In Expression (1), Qd represents a required flow rate of the hydraulic fluid in the hydraulic cylinder 20. P represents a discharge pressure of the hydraulic fluid discharged from the hydraulic pump 30. PL represents a load pressure of the hydraulic fluid in the hydraulic cylinder 20. ΔPC represents a setting differential pressure between an inlet side and an outlet side of the main operation valve 60. In the present embodiment, the differential pressure between the inlet side and the outlet side of the main operation valve 60 is set as the setting differential pressure ΔPC. The setting differential pressure ΔPC is preset for each of the first main operation valve 61, second main operation valve 62, and third main operation valve 63, and stored in the storage unit 146.

The distribution flow rate Qabk of the bucket cylinder 21, the distribution flow rate Qaar of the arm cylinder 22, and the distribution flow rate Qabm of the boom cylinder 23 are respectively calculated on the basis of Expressions (2), (3), and (4).

$$Qabk=Qdbk\times\sqrt{\{(P-PLbk)/\Delta PC\}} \quad (2)$$

$$Qaar=Qdar\times\sqrt{\{(P-PLar)/\Delta PC\}} \quad (3)$$

$$Qabm=Qdbm\times\sqrt{\{(P-PLbm)/\Delta PC\}} \quad (4)$$

In Expression (2), Qdbk represents a required flow rate of the hydraulic fluid in the bucket cylinder 21. PLbk represents a pressure of the hydraulic fluid in the bucket cylinder 21. In Expression (3), Qdar represents a required flow rate of the hydraulic fluid in the arm cylinder 22. PLar represents a hydraulic pressure of the hydraulic fluid in the arm cylinder 22. In Expression (4), Qdbm represents a required flow rate of the hydraulic fluid in the boom cylinder 23. PLbm is a load pressure of the hydraulic fluid in the boom cylinder 23. In the present embodiment, a setting differential pressure ΔPC between an inlet side and an outlet side of the first main operation valve 61, a setting differential pressure ΔPC between an inlet side and an outlet side of the second main operation valve 62, and a setting differential pressure ΔPC between an inlet side and an outlet side of the third main operation valve 63 are the same values.

The required flow rate Qd (Qdbk, Qdar, Qdbm) is calculated on the basis of the operation amount S (Sbk, Sar, Sbm) of the operation device 5. In the present embodiment, the required flow rate Qd (Qdbk, Qdar, Qdbm) is calculated on the basis of a pilot pressure detected by the operation amount sensor 90 (91, 92, 93). The operation amount S (Sbk, Sar, Sbm) of the operation device 5 corresponds one-to-one with the pilot pressure detected by the operation amount sensor 90 (91, 92, 93). The distribution flow rate calculation unit 112 converts the pilot pressure detected by the operation amount sensor 90 into a spool stroke of the main operation valve 60, and calculates the required flow rate Qd on the basis of the spool stroke. The first correlation data indicating a relation between the pilot pressure and the spool stroke of the main operation valve 60 and the second correlation data indicating a relation between the spool stroke of the main operation valve 60 and the required flow rate Qd are known data and stored in the storage unit 141 and the storage unit 142, respectively. The first correlation data indicating the relation between the pilot pressure and the spool stroke of the main operation valve 60 and the second correlation data indicating the relation between the spool stroke of the main operation valve 60 and the required flow rate Qd each include conversion table data.

The distribution flow rate calculation unit 112 acquires a detection signal of the bucket operation amount sensor 91 that has detected the pilot pressure acting on the first main operation valve 61. The distribution flow rate calculation unit 112 converts the pilot pressure acting on the first main operation valve 61 into a spool stroke of the first main operation valve 61 by using the first correlation data stored in the storage unit 141. Consequently, the spool stroke of the first main operation valve 61 is calculated on the basis of the detection signal of the bucket operation amount sensor 91 and the first correlation data stored in the storage unit 141. Furthermore, the distribution flow rate calculation unit 112 converts the calculated spool stroke of the first main operation valve 61 into a required flow rate Qdbk of the bucket cylinder 21 by using the second correlation data stored in the storage unit 142. Consequently, the distribution flow rate calculation unit 112 can calculate the required flow rate Qdbk of the bucket cylinder 21.

The distribution flow rate calculation unit 112 acquires a detection signal of the arm operation amount sensor 92 that has detected the pilot pressure acting on the second main operation valve 62. The distribution flow rate calculation unit 112 converts the pilot pressure acting on the second main operation valve 62 into a spool stroke of the second main operation valve 62 by using the first correlation data stored in the storage unit 141. Consequently, the spool stroke of the second main operation valve 62 is calculated on the basis of the detection signal of the arm operation amount sensor 92 and the first correlation data stored in the storage unit 141. Furthermore, the distribution flow rate calculation unit 112 converts the calculated spool stroke of the second main operation valve 62 into a required flow rate Qdar of the arm cylinder 22 by using the second correlation data stored in the storage unit 142. Consequently, the distribution flow rate calculation unit 112 can calculate the required flow rate Qdar of the arm cylinder 22.

The distribution flow rate calculation unit 112 acquires a detection signal of the boom operation amount sensor 93 that has detected the pilot pressure acting on the third main operation valve 63. The distribution flow rate calculation unit 112 converts the pilot pressure acting on the third main operation valve 63 into a spool stroke of the third main operation valve 63 by using the first correlation data stored in the storage unit 141. Consequently, the spool stroke of the third main operation valve 63 is calculated on the basis of the detection signal of the boom operation amount sensor 93 and the first correlation data stored in the storage unit 141. Furthermore, the distribution flow rate calculation unit 112 converts the calculated spool stroke of the third main operation valve 63 into a required flow rate Qdbm of the boom cylinder 23 by using the second correlation data stored in the storage unit 142. Consequently, the distribution flow rate calculation unit 112 can calculate the required flow rate Qdbm of the boom cylinder 23.

Meanwhile, as described above, the bucket load pressure sensor 81 includes the bucket load pressure sensor 81C and the bucket load pressure sensor 81L, and the pressure PLbk of the hydraulic fluid in the bucket cylinder 21 includes the pressure PLbkc of the hydraulic fluid in the cap-side space 21C of the bucket cylinder 21 and the pressure PLbk1 of the hydraulic fluid in the rod-side space 21L of the bucket cylinder 21. In the case of calculating the distribution flow rate Qabk by using Expression (2), the distribution flow rate calculation unit 112 selects any one of the pressure PLbkc and the pressure PLbk1 on the basis of a moving direction of the spool of the first main operation valve 61. For example, in the case where the spool of the first main operation valve 61 is moved in a first direction, the distribution flow rate calculation unit 112 calculates, on the basis of Expression (2), the distribution flow rate Qabk by using the pressure PLbkc detected by the bucket load pressure sensor 81C. In the case where the spool of the first main operation valve 61 is moved in a second direction that is an opposite direction of the first direction, the distribution flow rate calculation unit 112 calculates, on the basis of Expression (2), the distribution flow rate Qabk by using the pressure PLbk1 detected by the bucket load pressure sensor 81L.

Similarly, the arm load pressure sensor 82 includes the arm load pressure sensor 82C and the arm load pressure sensor 82L, and the pressure PLar of hydraulic fluid in the arm cylinder 22 includes the pressure PLarc of the hydraulic fluid in the cap-side space 22C of the arm cylinder 22 and the pressure PLar1 of the hydraulic fluid in the rod-side space 22L of the arm cylinder 22. In the case of calculating the distribution flow rate Qaar by using Expression (3), the distribution flow rate calculation unit 112 selects any one of the pressure PLarc and the pressure PLar1 on the basis of a moving direction of the spool of the second main operation valve 62. For example, in the case where the spool of the second main operation valve 62 is moved in a first direction, the distribution flow rate calculation unit 112 calculates, on the basis of Expression (3), the distribution flow rate Qaar by using the pressure PLarc detected by the arm load pressure sensor 82C. In the case where the spool of the second main operation valve 62 is moved in a second direction that is an opposite direction of the first direction, the distribution flow rate calculation unit 112 calculates, on the basis of Expression (3), the distribution flow rate Qaar by using the pressure PLar1 detected by the arm load pressure sensor 82L.

Similarly, the boom load pressure sensor 83 includes the boom load pressure sensor 83C and the boom load pressure sensor 83L, and the pressure PLbm of hydraulic fluid in the boom cylinder 23 includes the pressure PLbmc of the hydraulic fluid in the cap-side space 23C of the boom cylinder 23 and the pressure PLbm1 of the hydraulic fluid in the rod-side space 23L of the boom cylinder 23. In the case of calculating the distribution flow rate Qabm by using Expression (4), the distribution flow rate calculation unit 112 selects any one of the pressure PLbmc and the pressure PLbm1 on the basis of a moving direction of the spool of the third main operation valve 63. For example, in the case where the spool of the third main operation valve 63 is moved in a first direction, the distribution flow rate calculation unit 112 calculates, on the basis of Expression (4), the distribution flow rate Qabm by using the pressure PLbmc detected by the boom load pressure sensor 83C. In the case where the spool of the third main operation valve 63 is moved in a second direction that is an opposite direction of the first direction, the distribution flow rate calculation unit 112 calculates, on the basis of Expression (4), the distribution flow rate Qabm by using the pressure PLbm1 detected by the boom load pressure sensor 83L.

In the present embodiment, the discharge pressure P of the hydraulic fluid discharged from the hydraulic pump 30 is detected by the discharge pressure sensor 800. Meanwhile, when the discharge pressure P of the hydraulic fluid discharged from the hydraulic pump 30 is unknown in Expressions (1) to (4), the distribution flow rate calculation unit 112 may calculate the distribution flow rates Qabk, Qaar, and Qabm by repeating numerical calculation such that Expression (5) become convergent.

$$Qlp=Qabk+Qaar+Qabm \tag{5}$$

In Expression (5), Qlp represents a pump limit flow rate. The pump limit flow rate Qlp is set to a minimum value among the maximum discharge flow rate Qmax of the hydraulic pump 30, a target discharge flow rate Qt1 of the first hydraulic pump 31 determined on the basis of target output of the first hydraulic pump 31, and a target discharge flow rate Qt2 of the second hydraulic pump 32 determined on the basis of target output of the second hydraulic pump 32.

Meanwhile, in the present embodiment, the operation device 5 includes an operating lever of a pilot pressure system, and a pressure sensor is used as the operation amount sensor 90 (91, 92, 93). The operation device 5 may also include an operating lever of an electric system. In the case where the operation device 5 includes the operating lever of the electric system, a stroke sensor that can detect a lever stroke indicating a stroke of the operating lever is used as the operation amount sensor (91, 92, 93). The distribution flow rate calculation unit 112 converts a lever stroke detected by the operation amount sensor 90 into a spool stroke of the main operation valve 60, and can calculate the required flow rate Qd on the basis of the spool stroke. The distribution flow rate calculation unit 112 can convert the lever stroke into the spool stroke by using a predetermined conversion table.

<Switching Device Control Unit>

The switching device control unit 114 outputs a command signal to control the first merging-separating valve 67 so as to perform switching to any one of the merged state or the separated state on the basis of a comparison result between the distribution flow rate Qa calculated in the distribution flow rate calculation unit 112 and a threshold value Qs.

The threshold value Qs is a threshold value for the distribution flow rate Qa of the hydraulic cylinder 20. When the distribution flow rate Qa calculated in the distribution flow rate calculation unit 112 is the threshold value Qs or less, the switching device control unit 114 outputs a command signal to the first merging-separating valve 67 so as to perform switching to the separated state. When the distribution flow rate Qa calculated in the distribution flow rate calculation unit 112 is larger than the threshold value Qs, the switching device control unit 114 outputs a command signal to the first merging-separating valve 67 so as to perform switching to the merged state.

In the present embodiment, the threshold value Qs is the maximum discharge flow rate Qmax of the hydraulic fluid that can be discharged by each of the first hydraulic pump 31 and the second hydraulic pump 32. In other words, in the present embodiment, the switching device control unit 114 controls the first merging-separating valve 67 on the basis of the comparison result between the distribution flow rate Qa and the maximum discharge flow rate Qmax. When the distribution flow rate Qa is the most discharge flow rate Qmax or less, the switching device control unit 114 outputs a command signal to the first merging-separating valve 67 so as to perform switching to the separated state. When the distribution flow rate Qa is larger than the maximum discharge flow rate Qmax, the switching device control unit 114 outputs a command signal to the first merging-separating valve 67 so as to perform switching to the merged state.

In the present embodiment, when the sum of the distribution flow rate Qabk of the hydraulic fluid supplied to the bucket cylinder 21 and the distribution flow rate Qaar of the hydraulic fluid supplied to the arm cylinder 22 is equal to or less than the maximum discharge flow rate Q1max of the first hydraulic pump 31 and also the distribution flow rate Qabm of the hydraulic fluid supplied to the boom cylinder 23 is equal to or less than the maximum discharge flow rate Q2max of the second hydraulic pump 32, the switching device control unit 114 outputs a command signal to the first merging-separating valve 67 so as to perform switching to the separated state. When the sum of the distribution flow rate Qabk of the hydraulic fluid supplied to the bucket cylinder 21 and the distribution flow rate Qaar of the hydraulic fluid supplied to the arm cylinder 22 is larger than the maximum discharge flow rate Q1max of the first hydraulic pump 31, or when the distribution flow rate Qabm of the hydraulic fluid supplied to the boom cylinder 23 is larger than the maximum discharge flow rate Q2max of the second hydraulic pump 32, the switching device control unit 114 outputs a command signal to the first merging-separating valve 67 so as to perform switching to the merged state.

<Pump Flow Rate Calculation Unit>

The pump flow rate calculation unit 116 calculates, in the separated state, each of the discharge flow rate Q1 of the hydraulic fluid discharged from the first hydraulic pump 31 and the discharge flow rate Q2 of the hydraulic fluid discharged from the second hydraulic pump 32 on the basis of the distribution flow rate Qa calculated in the distribution flow rate calculation unit 112. In the present embodiment, in the separated state, the discharge flow rate Q1 of the hydraulic fluid discharged from the first hydraulic pump 31 is the sum of the distribution flow rate Qabk of the hydraulic fluid supplied to the bucket cylinder 21 and the distribution flow rate Qaar of the hydraulic fluid supplied to the arm cylinder 22 (Q1=Qabk+Qaar). In the separated state, the discharge flow rate Q2 of the hydraulic fluid discharged from the second hydraulic pump 32 is the distribution flow rate Qabm of the hydraulic fluid supplied to the boom cylinder 23 (Q2=Qabm).

Note that the pump flow rate calculation unit 116 can calculate the discharge flow rates Q1 and Q2 on the basis of capacity [cc/rev] of the hydraulic pump 30 (31, 32) calculated from a detection value of the swash plate angle sensor 30S (31S, 32S) and an engine speed of the engine 4 detected by the engine speed sensor 4R.

<Merged-State Pump Output Calculation Unit/Separated-State Pump Output Calculation Unit/Excessive Output Calculation Unit>

The merged-state pump output calculation unit 118 calculates merged-state pump output Wa indicating output Wa1 of the first hydraulic pump 31 and output Wa2 of the second hydraulic pump 32 required in the merged state on the basis of the distribution flow rate Qa calculated in the distribution flow rate calculation unit 112. In the present embodiment, the merged-state pump output Wa is the sum of the output Wa1 of the first hydraulic pump 31 and the output Wa2 of the second hydraulic pump 32 required in the merged state (Wa=Wa1+Wa2).

The separated-state pump output calculation unit 120 calculates separated-state pump output Wb indicating output Wb1 of the first hydraulic pump 31 and output Wb2 of the second hydraulic pump 32 required in the separated state on the basis of the distribution flow rate Qa calculated in the distribution flow rate calculation unit 112. In the present embodiment, the separated-state pump output Wb is the sum of the output Wb1 of the first hydraulic pump 31 and the output Wb2 of the second hydraulic pump 32 required in the separated state (Wb=Wb1+Wb2).

The excessive output calculation unit 122 calculates excessive output Ws of the engine 4 on the basis of the merged-state pump output Wa and the separated-state pump output Wb. In the present embodiment, the excessive output Ws is a difference between the merged-state pump output Wa and the separated-state pump output Wb (Ws=Wa−Wb).

The merged-state pump output calculation unit 118 calculates the merged-state pump output Wa on the basis of: a higher discharge pressure Pmax out of the discharge pressure P1 of the hydraulic fluid discharged from the first hydraulic pump 31 and the discharge pressure P2 of the hydraulic fluid discharged from the second hydraulic pump 32 in the separated state; the discharge flow rate Q1 of the hydraulic fluid discharged from the first hydraulic pump 31 in the separated state; and the discharge flow rate Q2 of the hydraulic fluid discharged from the second hydraulic pump 32 in the separated state.

In the present embodiment, the separated-state pump output calculation unit 120 calculates the separated-state pump output Wb on the basis of: the discharge pressure P1 and the discharge flow rate Q1 of the hydraulic fluid discharged from the first hydraulic pump 31 in the separated state; and the discharge pressure P2 and the discharge flow rate Q2 of the hydraulic fluid discharged from second hydraulic pump 32 in the separated state.

Figure 5:
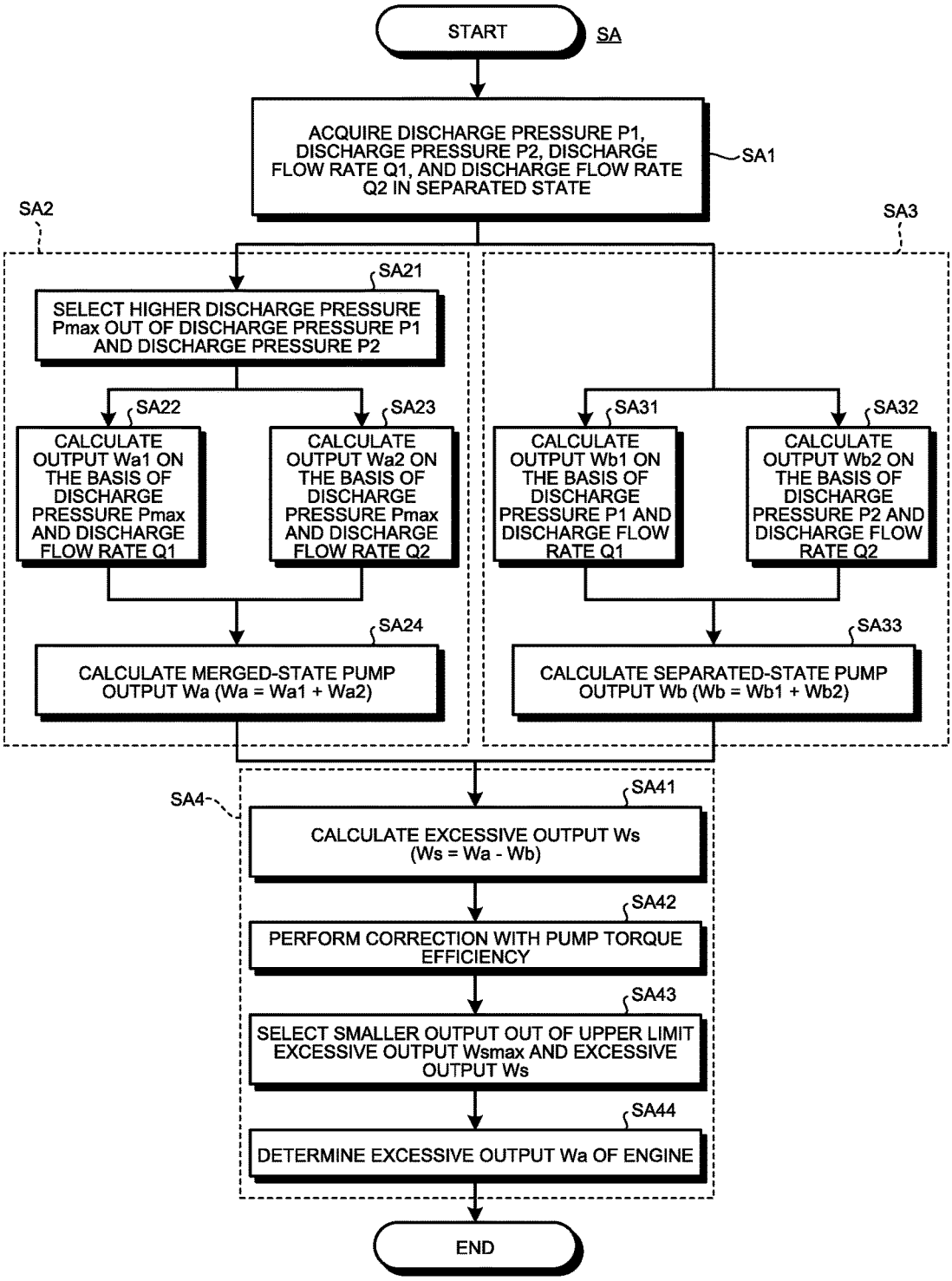
FIG. 5 is a flowchart illustrating exemplary processing performed by a merged-state pump output calculation unit, a separated-state pump output calculation unit, and an excessive output calculation unit according to the present embodiment.

FIG. 5 is a flowchart illustrating exemplary processing SA performed by the merged-state pump output calculation unit 118, separated-state pump output calculation unit 120, and excessive output calculation unit 122 according to the present embodiment. Note that, in FIG. 5, processing in step SA2 (SA21, SA22, SA23, SA24) is processing performed by the merged-state pump output calculation unit 118, processing in step SA3 (SA31, SA32, SA33) is processing performed by the separated-state pump output calculation unit 120, and processing in step SA4 (SA41, SA42, SA43, SA44) is processing performed by the excessive output calculation unit 122.

The process illustrated in FIG. 5 is the processing in the separated state. As described above, when the distribution flow rate Qa calculated in the distribution flow rate calculation unit 112 is the threshold Qs or less, the switching device control unit 114 brings the hydraulic circuit 40 into the separated state.

The control device 100 acquires the discharge pressure P1 of the first hydraulic pump 31, discharge pressure P2 of the second hydraulic pump 32, discharge flow rate Q1 of the first hydraulic pump 31, and discharge flow rate Q2 of the second hydraulic pump 32 in the separated state (step SA1).

The discharge flow rate Q1 and the discharge flow rate Q2 are calculated by the pump flow rate calculation unit 116. The discharge pressure P1 and the discharge pressure P2 are acquired by the discharge pressure sensor 800 (801, 802).

The merged-state pump output calculation unit 118 calculates the output Wa of the hydraulic pump 30 in the merged state on the assumption that the hydraulic circuit 40 is in the merged state although the hydraulic circuit 40 is in the separated state. The merged-state pump output calculation unit 118 selects a higher discharge pressure Pmax out of the discharge pressure P1 of the hydraulic fluid discharged from the first hydraulic pump 31 and the discharge pressure P2 of the hydraulic fluid discharged from the second hydraulic pump 32 in the separated state (step SA21). In the present embodiment, it is assumed that the discharge pressure Pmax is the discharge pressure P1.

The merged-state pump output calculation unit 118 calculates, on the basis of the discharge pressure Pmax and the discharge flow rate Q1 of the hydraulic fluid discharged from the first hydraulic pump 31 in the separated state, the output Wa1 of the first hydraulic pump 31 required on the assumption that the hydraulic circuit 40 is in the merged state (step SA22). The output Wa1 is calculated on the basis of the product of the discharge pressure Pmax (P1) and the discharge flow rate Q1.

The merged-state pump output calculation unit 118 calculates, on the basis of the discharge pressure Pmax and the discharge flow rate Q2 of the hydraulic fluid discharged from the second hydraulic pump 32 in the separated state, the output Wa2 of the second hydraulic pump 32 required on the assumption that the hydraulic circuit 40 is in the merged state (step SA23). The output Wa2 is calculated on the basis of the product of the discharge pressure Pmax (P1) and the discharge flow rate Q2.

The merged-state pump output calculation unit 118 calculates the merged-state pump output Wa required on the assumption that the hydraulic circuit 40 is in the merged state (step SA24). In the present embodiment, the merged-state pump output Wa is the sum of the output Wa1 of the first hydraulic pump 31 and the output Wa2 of the second hydraulic pump 32 on the assumption that the hydraulic circuit 40 is in the merged state (Wa=Wa1+Wa2).

The hydraulic circuit 40 is in the separated state, and the separated-state pump output calculation unit 120 calculates the output Wb of the hydraulic pump 30 in the separated state. The separated-state pump output calculation unit 120 calculates the output Wb1 of the first hydraulic pump 31 required when the hydraulic circuit 40 is in the separated state, on the basis of: the discharge pressure P1 of the hydraulic fluid discharged from the first hydraulic pump 31 in the separated state; and the discharge flow rate Q1 of the hydraulic fluid discharged from the first hydraulic pump 31 in the separated state (step SA31). The output Wb1 is calculated on the basis of the product of the discharge pressure P1 and the discharge flow rate Q1.

The separated-state pump output calculation unit 120 calculates the output Wb2 of the second hydraulic pump 32 required when the hydraulic circuit 40 is in the separated state on the basis of: the discharge pressure P2 of the hydraulic fluid discharged from the second hydraulic pump 32 in the separated state; and the discharge flow rate Q2 of the hydraulic fluid discharged from the second hydraulic pump 32 in the separated state (step SA32). The output Wb2 is calculated on the basis of the product of the discharge pressure P2 and the discharge flow rate Q2.

The separated-state pump output calculation unit 120 calculates the separated-state pump output Wb when the hydraulic circuit 40 is in the separated state (step SA33). In the present embodiment, the separated-state pump output Wb is the sum of the output Wb1 of the first hydraulic pump 31 and the output Wb2 of the second hydraulic pump 32 required when the hydraulic circuit 40 is in the separated state (Wb=Wb1+Wb2).

The excessive output calculation unit 122 calculates excessive output Ws of the engine 4 on the basis of: the merged-state pump output Wa calculated in the merged-state pump output calculation unit 118; and the separated-state pump output Wb calculated in the separated-state pump output calculation unit 120 (step SA41). In the present embodiment, the excessive output Ws includes a difference between the merged-state pump output Wa and the separated-state pump output Wb (Ws=Wa−Wb).

When the hydraulic circuit 40 is in the merged state, the pressure of the hydraulic fluid flowing in the hydraulic circuit 40 is to be the higher discharge pressure Pmax out of the discharge pressure P1 of the first hydraulic pump 31 and the discharge pressure P2 of the second hydraulic pump 32. Therefore, the output Wa of the hydraulic pump 30 on the assumption that the hydraulic circuit 40 is in the merged state is calculated on the basis of the discharge pressure Pmax. On the other hand, when the hydraulic circuit 40 is in the separated state, the pressure of the hydraulic fluid flowing in the hydraulic circuit 40 is separated into the discharge pressure P1 of the first hydraulic pump 31 and the discharge pressure P2 of the second hydraulic pump 32. Therefore, the output Wb of the hydraulic pump 30 when the hydraulic circuit 40 is in the separated state is calculated on the basis of each of the discharge pressure P1 and the discharge pressure P2. Additionally, the merged-state pump output Wa calculated on the basis of the discharge pressure Pmax has a value larger than the separated-state pump output Wb calculated on the basis of each of the discharge pressure P1 and the discharge pressure P2. Therefore, the excessive output Ws results in a positive value.

In the present embodiment, the excessive output calculation unit 122 corrects the excessive output Ws calculated in step SA41 by using pump torque efficiency (step SA42). Furthermore, in the present embodiment, an upper limit excessive output Wsmax indicating an upper limit value of the excessive output Ws is preset and stored in the storage unit 146. The excessive output calculation unit 122 selects a smaller value out of the upper limit excessive output Wsmax stored in the storage unit 146 and the excessive output Ws calculated in step SA41 (step SA43).

The excessive output calculation unit 122 determines any one of the upper limit excessive output Wsmax and the excessive output Ws selected in step SA43 as final excessive output Ws (step SA44).

<Target Output Calculation Unit>

In FIG. 4, the target output calculation unit 124 calculates target output Wr of the engine 4 on the basis of: the operation amount S of the operation device 5; the discharge pressure P1 of the hydraulic fluid discharged from the first hydraulic pump 31; and the discharge pressure P2 of the hydraulic fluid discharged from the second hydraulic pump 32.

In the present embodiment, the target output Wr of the engine 4 is calculated on the basis of the sum of the target output of the engine 4 required to drive the work unit 10 and target output of the engine 4 required to drive a fan that cools the engine 4.

Figure 6:
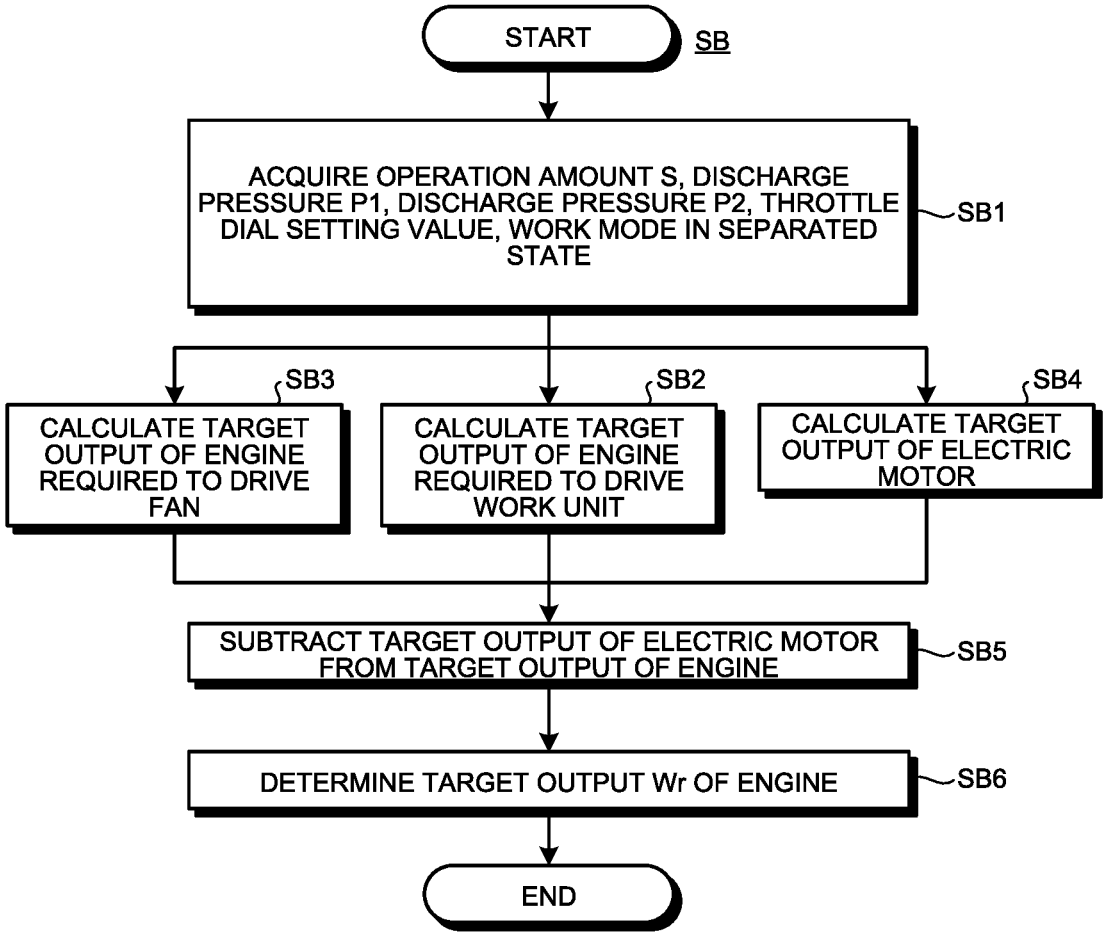
FIG. 6 is a flowchart illustrating exemplary processing performed by a target output calculation unit according to the present embodiment.

FIG. 6 is a flowchart illustrating exemplary processing SB performed by the target output calculation unit 124 according to the present embodiment. The processing illustrated in FIG. 6 is processing in the separated state.

The control device 100 acquires the operation amount S of the operation device 5, discharge pressure P1 of the first hydraulic pump 31, and discharge pressure P2 of the second hydraulic pump 32 in the separated state (step SB1).

The operation amount S of the operation device 5 is acquired by the operation amount sensor 90 (91, 92, 93). The discharge pressure P1 and the discharge pressure P2 are acquired by the discharge pressure sensor 800 (801, 802).

Furthermore, in the present embodiment, the control device 100 also acquires a setting value of the throttle dial 33 and a work mode selected by the work mode selector 34.

The target output calculation unit 124 calculates the target output of the engine 4 required to drive the work unit 10 on the basis of: the operation amount S of the operation device 5; the discharge pressure P1 of the first hydraulic pump 31; the discharge pressure P2 of the second hydraulic pump 32; the setting value of the throttle dial 33; and the work mode selected by the work mode selector 34 (step SB2).

Additionally, the target output calculation unit 124 calculates the target output of the engine 4 required to drive the fan that cools the engine 4 (step SB3).

In the present embodiment, the excavator 1 is at least partly driven by output of the electric motor 25. The target output calculation unit 124 calculates the target output of the electric motor 25 (step SB4).

The target output calculation unit 124 calculates the sum of the target output of the engine 4 required to drive the work unit 10 calculated in step SB2 and the target output of the engine 4 required to drive the fan calculated in step SB3. Additionally, the target output calculation unit 124 reduces the target output of the electric motor 25 calculated in step SB4 from the sum of the target output of the engine 4 required to drive the work unit 10 and the target output of the engine 4 required to drive the fan (step SB5). In other words, in the present embodiment, the excavator 1 is the excavator of the hybrid system, and output of the electric motor 25 is supplemented to the output of the engine 4. Therefore, the target output of the engine 4 can be reduced by an amount of the target output of the electric motor 25.

The target output calculation unit 124 determines the target output of the engine 4 calculated in step SB5 as the final target output Wr of the engine 4 (step SB6).

<Reduced Output Calculation Unit>

In FIG. 4, the reduced output calculation unit 126 calculates reduced output Wc of the engine 4 more reduced than the target output Wr by correcting the target output Wr of the engine 4 calculated in the target output calculation unit 124 on the basis of the excessive output Ws calculated in the excessive output calculation unit 122.

Figure 7:
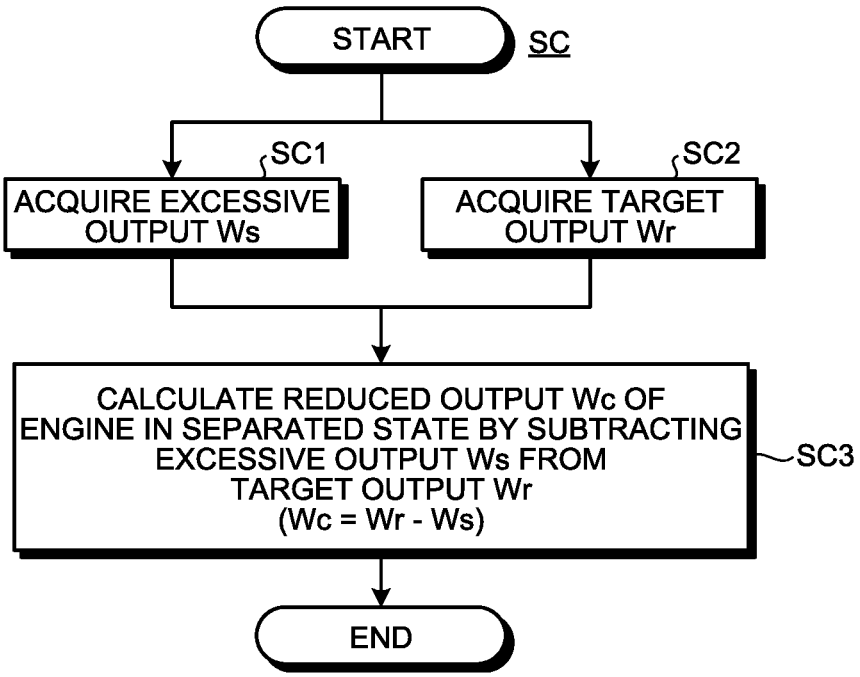
FIG. 7 is a flowchart illustrating exemplary processing performed by a reduced output calculation unit according to the present embodiment.

FIG. 7 is a flowchart illustrating exemplary processing SC performed by the reduced output calculation unit 126 according to the present embodiment. The processing illustrated in FIG. 7 is processing in the separated state.

The reduced output calculation unit 126 acquires the excessive output Ws of the engine 4 calculated in the excessive output calculation unit 122 (step SC1).

Furthermore, the reduced output calculation unit 126 acquires the target output Wr of the engine 4 calculated in the target output calculation unit 124 (step SC2).

The reduced output calculation unit 126 subtracts the excessive output Ws from the target output Wr of the engine 4 and determines the reduced output Wc that is final target output of the engine 4 in the separated state (step SC3). In the present embodiment, that is [Wc=Wr−Ws].

<Target Engine Speed Calculation Unit/Lower Limit Engine Speed Setting Unit/Filter Processing Unit>

In FIG. 4, the target engine speed calculation unit 128 calculates a target engine speed Nr of the engine 4 in the separated state on the basis of: the target output of the engine 4 calculated in the target output calculation unit 124 and the third correlation data stored in the storage unit 143. The third correlation data stored in the storage unit 143 is known data indicating a relation between output of the engine 4 and an engine speed of the engine 4. The third correlation data indicating the relation between the output of the engine 4 and the engine speed of the engine 4 includes conversion table data.

In the separated state, the lower limit engine speed setting unit 130 sets a lower limit engine speed Nmin indicating a lower limit value of the engine speed of the engine 4 such that hydraulic fluid is supplied to each of bucket cylinder 21, arm cylinder 22, and boom cylinder 23 at the distribution flow rate Qabk, distribution flow rate Qaar, and distribution flow rate Qabm calculated in the distribution flow rate calculation unit 112.

As described above, the switching device control unit 114 determines whether to bring the hydraulic circuit 40 into the separated state on the basis of the distribution flow rate Qa calculated in the distribution flow rate calculation unit 112. In the present embodiment, an engine speed of the engine 4 that is the lower limit engine speed Nmin or more is an engine speed of the engine 4 at which the separated state can be kept. When the engine 4 is driven at the engine speed that is the lower limit engine speed Nmin or more, hydraulic fluid is supplied to each of the plurality of hydraulic cylinders 20 (21, 22, 23) at the distribution flow rate Qa calculated in the distribution flow rate calculation unit 112, and the separated state is kept.

The filter processing unit 132 applies filter processing to the operation amount S of the operation device 5 when an operation speed of the operation device 5 is a predetermined prescribed value or more in the separated state. The operation speed of the operation device 5 is a change amount of the operation amount of the operation device 5 per unit time.

As described above, the operation amount S of the operation device 5 corresponds one-to-one with a detection value (pressure value of pilot pressure) of the operation amount sensor 90. The operation speed of the operation device 5 is equivalent to the change amount of the detection value of the operation amount sensor 90 per unit time. In the present embodiment, the filter processing unit 132 applies filter processing to the detection value of the operation amount sensor 90 when a changed speed of the detection value of the operation amount sensor 90 is the predetermined prescribed value or more in the separated state.

In the present embodiment, the distribution flow rate calculation unit 112 calculates the distribution flow rate Qabk, distribution flow rate Qaar, and distribution flow rate Qabm of the hydraulic fluid supplied to each of the bucket cylinder 21, arm cylinder 22, and boom cylinder 23 on the basis of the operation amount S of the operation device 5 that has been applied with the filter processing by the filter processing unit 132.

Figure 8:
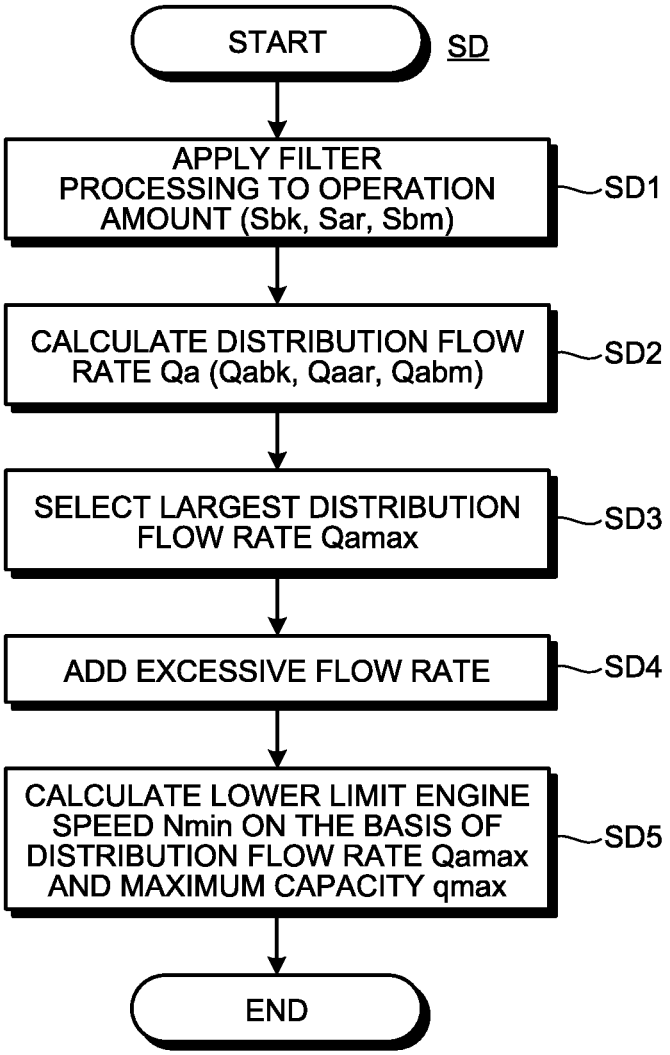
FIG. 8 is a flowchart illustrating exemplary processing performed by a target engine speed calculation unit, a lower limit engine speed setting unit, and a filter processing unit according to the present embodiment.

FIG. 8 is a flowchart illustrating exemplary processing SD performed by the target engine speed calculation unit 128, lower limit engine speed setting unit 130, and filter processing unit 132 according to the present embodiment. The processing illustrated in FIG. 8 is the processing in the separated state.

In the separated state, the filter processing unit 132 applies the filter processing to the operation amount S (Sbk, Sar, Sbm) of the operation device 5 when the operation speed of the operation device 5 is the prescribed value or more (step SD1).

In the present embodiment, the filter processing includes primary low-pass filter processing. The higher the operation speed of the operation device 5 is, the larger time constant the filter processing unit 132 sets for the primary low-pass filter processing.

The distribution flow rate calculation unit 112 calculates the distribution flow rate Qabk, distribution flow rate Qaar, and distribution flow rate Qabm of the hydraulic fluid supplied to each of the bucket cylinder 21, arm cylinder 22, and boom cylinder 23 on the basis of the operation amount S of the operation device 5 that has been applied with the filter processing by the filter processing unit 132 (step SD2).

The lower limit engine speed setting unit 130 selects a largest distribution flow rate Qamax from among the distribution flow rate Qabk, distribution flow rate Qaar, and distribution flow rate Qabm calculated in step SD2 (step SD3). In the present embodiment, it is assumed that the largest distribution flow rate Qamax is the distribution flow rate Qabk.

The lower limit engine speed setting unit 130 adds a preset margin flow rate to the distribution flow rate Qamax (step SD4). The lower limit engine speed setting unit 130 determines, as the distribution flow rate Qamax, the sum of the distribution flow rate Qamax selected in step SD3 and the margin flow rate.

The lower limit engine speed setting unit 130 calculates the lower limit engine speed Nmin on the basis of the distribution flow rate Qamax determined in step SD4 and the maximum capacity qmax [cc/rev] of the hydraulic pump 30 (step SD5).

<Engine Control Unit>

In FIG. 4, the engine control unit 134 outputs a command signal to control the engine 4 on the basis of the reduced output We of the engine 4 calculated in the reduced output calculation unit 126 in the separated state. In the present embodiment, the engine control unit 134 controls the engine 4 such that the engine 4 is driven at an engine speed equal to or more than the lower limit engine speed Nmin calculated in the lower limit engine speed setting unit 130. Additionally, the engine control unit 134 controls the engine 4 such that the engine 4 is driven at a higher engine speed out of the target engine speed Nr and the lower limit engine speed Nmin by comparing the target engine speed Nr of the engine 4 calculated in the target engine speed calculation unit 128 with the lower limit engine speed Nmin calculated in the lower limit engine speed setting unit 130.

[Engine Control]

Figure 9:
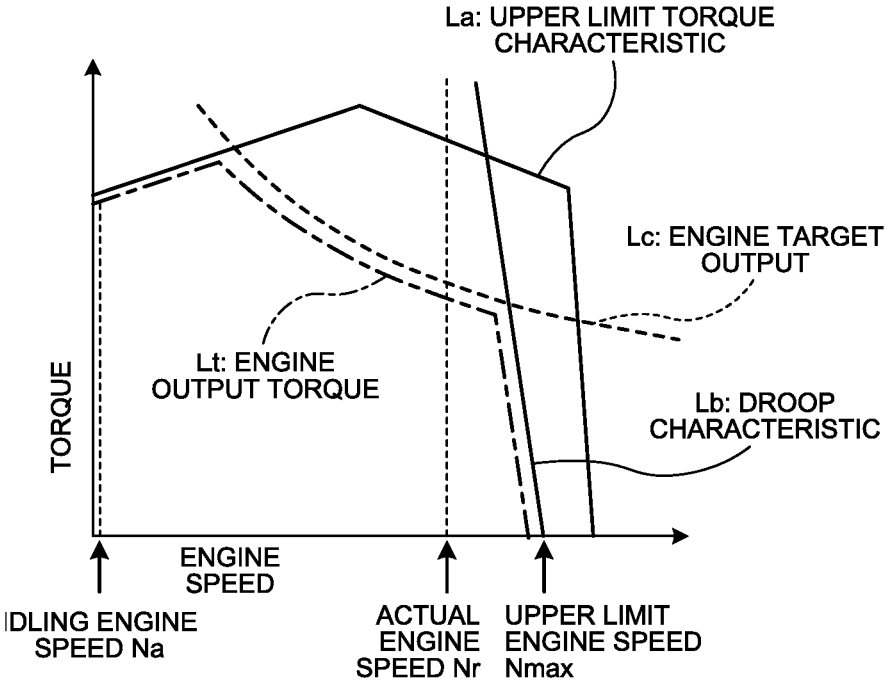
FIG. 9 is a diagram illustrating an exemplary torque chart of an engine according to the present embodiment.

FIG. 9 is a diagram illustrating an exemplary torque chart of the engine 4 according to the present embodiment. An upper limit torque characteristic of the engine 4 is defined by a maximum output torque line La illustrated in FIG. 9. A droop characteristic of the engine 4 is defined by an engine droop line Lb illustrated in FIG. 9. Engine target output is defined by an equal output line Lc illustrated in FIG. 9.

The control device 100 controls the engine 4 on the basis of the upper limit torque characteristic, droop characteristic, and engine target output. The control device 100 controls the engine 4 such that the engine speed and torque of the engine 4 do not exceed the maximum output torque line La, engine droop line Lb, and equal output line Lc.

In other words, the control device 100 outputs a command signal to control the engine 4 such that the engine speed and torque of the engine 4 do not exceed an engine output torque line Lt defined by the maximum output torque line La, engine droop line Lb, and equal output line Lc.

For example, during excavating operation of the work unit 10, the engine 4 is driven in a high load state in which a heavy load is applied. On the other hand, in the case of performing operation like lowering the work unit 10 in the gravity direction, the engine 4 is driven in a no-load state in which almost no load is applied.

In the present embodiment, the upper limit engine speed Nmax that is the target engine speed of the engine 4 in the no-load state is set. In the torque chart, the engine droop line Lb passes through the upper limit engine speed Nmax and is set so as to have a predetermined prescribed inclination.

The control device 100 outputs a command signal to change the engine speed of the engine 4 on the basis of the operation amount S of the operation device 5 and the load applied to the work unit 10. For example, when the state transitions from the no-load state to the load state while the engine 4 in an idling state is rotated at an idling engine speed Na, the engine speed of the engine 4 is increased from the idling engine speed Na to an actual engine speed Nr. Note that the actual engine speed Nr of the engine 4 is controlled so as not to become the upper limit engine speed Nmax or more. Furthermore, when the state transitions from the load state to the no-load state while the engine 4 is rotated at the actual engine speed Nr, the engine speed of the engine 4 is rapidly increased but controlled so as not to become the upper limit engine speed Nmax or more.

An operator sets a fuel injection amount to the engine 4 by operating the throttle dial 33. The upper limit engine speed Nmax of the engine 4 is set by the throttle dial 33. The control device 100 outputs a command signal to control the fuel injection amount on the basis of load fluctuation of the work unit 10 such that the actual engine speed Nr of the engine 4 does not become equal to or more than the upper limit engine speed Nmax set by the throttle dial 33.

Figure 10:
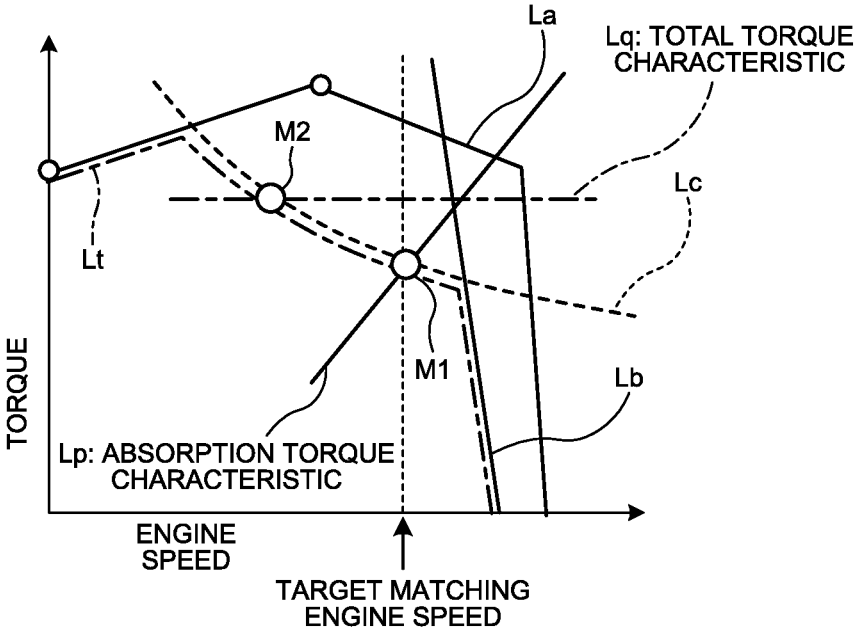
FIG. 10 is a diagram illustrating an exemplary matching state of an engine and a hydraulic pump according to the present embodiment.
Figure 11:
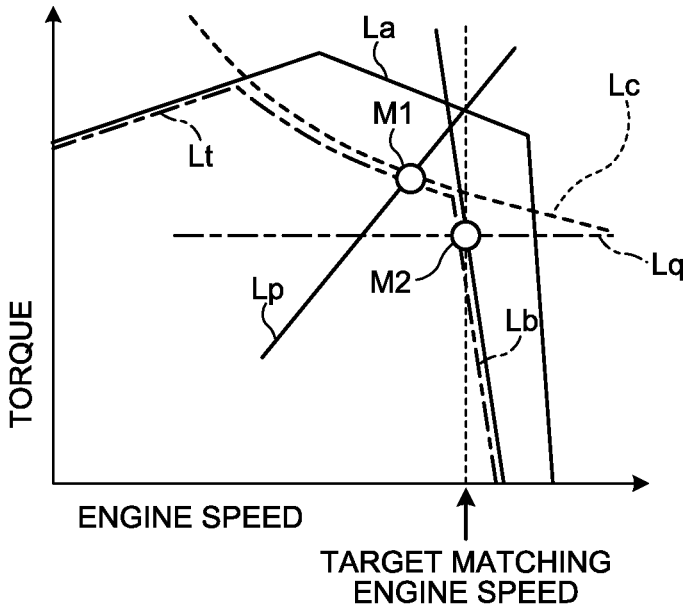
FIG. 11 is a diagram illustrating an exemplary matching state of the engine and the hydraulic pump according to the present embodiment.

FIGS. 10 and 11 are diagrams illustrating exemplary matching states of the engine 4 and the hydraulic pump 30 according to the present embodiment.

As illustrated in FIGS. 10 and 11, absorption torque of the hydraulic pump 30 that is varied by the actual engine speed Nr of the engine 4 is set in accordance with an absorption torque characteristic Lp. Furthermore, a total torque characteristic of the hydraulic pump 30 in the separated state is defined by a pump total torque line Lq as a total value obtained by adding distribution torque of the first hydraulic pump 31 to distribution torque of the second hydraulic pump 32. Final absorption torque of the hydraulic pump 30 is set by using a smaller value out of values of the torque determined by Lp and Lq.

A matching point M1 is defined at an intersection point of the absorption torque characteristic Lp with the engine output torque line Lt. A matching point M2 is defined at an intersection point of the pump total torque line Lq with the engine output torque line Lt.

For example, when a load to the work unit 10 is increased, the engine speed of the engine 4 transitions to a matching point having smaller torque of the engine 4 out of the matching point M1 and the matching point M2. In FIG. 10, since the torque of the engine 4 at the matching point M1 is smaller than the torque of the engine 4 at the matching point M2, the engine speed of the engine 4 is stabilized at the matching point M1. In FIG. 11, since the torque of the engine 4 at the matching point M2 is smaller than the torque of the engine 4 at the matching point M1, the engine speed of the engine 4 is stabilized at the matching point M2.

In other words, as illustrated in FIG. 10, in the case where the work unit 10 is in a heavy load state and the engine speed of the engine 4 is low, and also the torque of the matching point M1 is smaller than the torque of the matching point M2, the control device 100 actuates the work unit 10 by matching the output of the engine 4 to the output of the hydraulic pump 30 at the matching point M1.

On the other hand, as illustrated in FIG. 11, in the case where the torque of the matching point M2 is smaller than the torque of the matching point M1, the control device 100 actuates the work unit 10 by matching the output of the engine 4 to the output of the hydraulic pump 30 at the matching point M2.

[Control Method]

As described above, in the present embodiment, the hydraulic circuit 40 is switched between the merged state and the separated state. During the excavating operation of the work unit 10, a heavy load is applied to the bucket 11 or the arm 12 that is a work unit element provided at a distal end side of the work unit 10 with high possibility. On the other hand, during the excavating operation of the work unit 10, a small load is applied to the boom 13 that is a work unit element provided on a proximal end side of the work unit 10 with high possibility. In such a case, it is possible to decrease the discharge pressure P2 of the second hydraulic pump 32 while increasing the discharge pressure P1 of the first hydraulic pump 31 by bringing the hydraulic circuit 40 into the separated state.

On the other hand, in the case where the hydraulic circuit 40 is in the merged state, the discharge pressure P2 of the second hydraulic pump 32 is increased to a pressure equivalent to the discharge pressure P1 of the first hydraulic pump 31 that is the high pressure side by the function of the pressure compensating valve 70. Therefore, in the case where output of the engine 4 is set on the assumption of the merged state, the engine 4 is driven with unnecessarily high output for a load in the separated state. When the engine 4 is driven with such unnecessarily high output, improvement in fuel consumption of the engine 4 is hindered.

In the present embodiment, when the hydraulic circuit 40 is in the separated state, calculated is the merged-state pump output Wa indicating output of the hydraulic pump 30 on the assumption that the hydraulic circuit 40 is in the merged state. Additionally, when the hydraulic circuit 40 is in the separated state, calculated is the separated-state pump output Wb indicating output of the hydraulic pump 30 in the separated state. The excessive output Ws of the engine 4 is calculated on the basis of the merged-state pump output Wa and the separated-state pump output Wb. The reduced output Wc of the engine 4 more reduced than the target output Wr of the engine 4 is calculated on the basis of the excessive output Ws.

In the present embodiment, the engine 4 is controlled on the basis of the reduced output Wc when the hydraulic circuit 40 is in the separated state. Consequently, the engine 4 is prevented from being driven with the unnecessarily high output.

Figure 12:
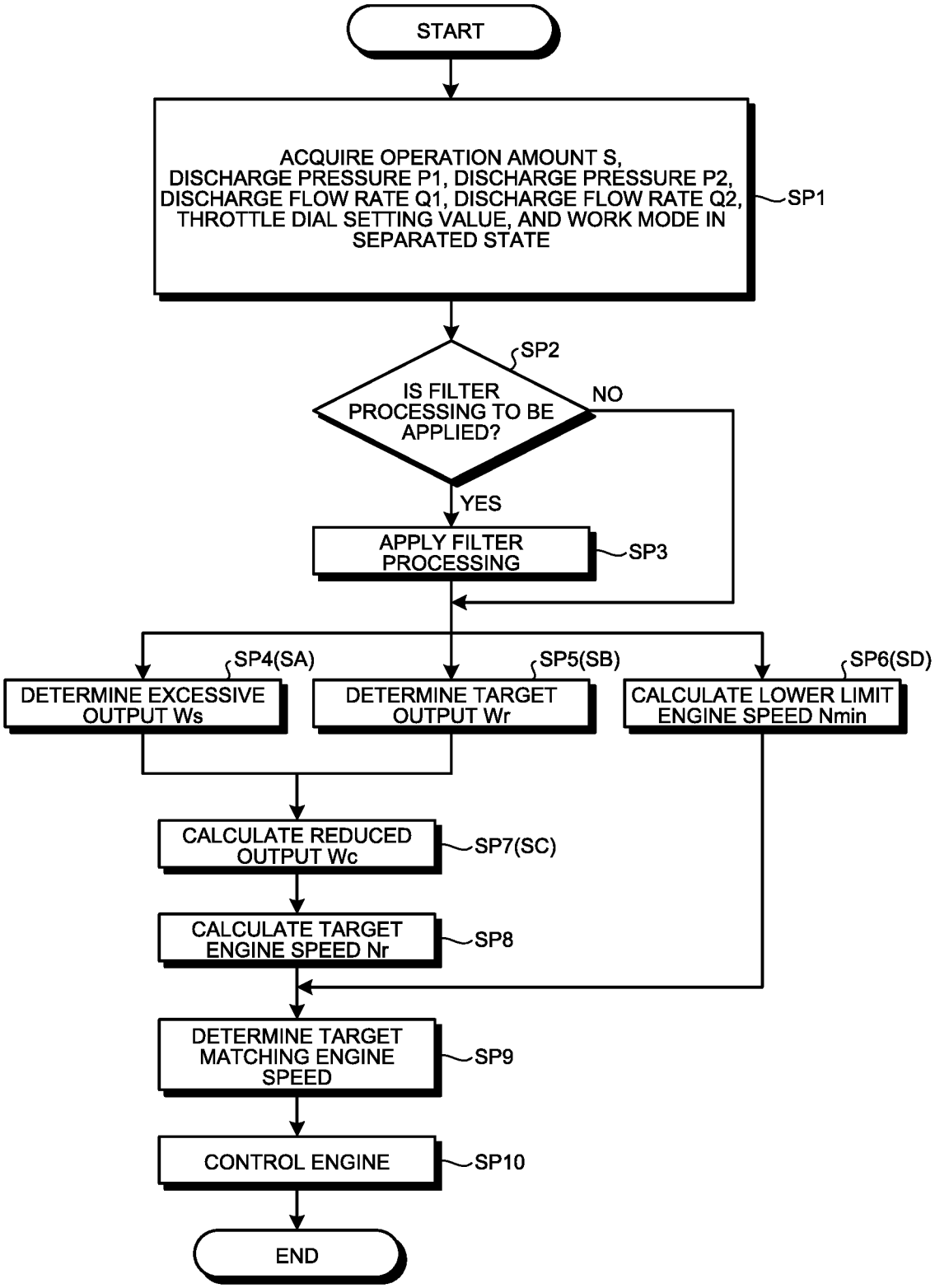
FIG. 12 is a flowchart illustrating an exemplary control method for the work machine according to the present embodiment.

FIG. 12 is a flowchart illustrating an exemplary control method for the excavator 1 according to the present embodiment. The control device 100 acquires an operation amount S of the operation device 5, a discharge pressure P1 of the first hydraulic pump 31, a discharge pressure P2 of the second hydraulic pump 32, a discharge flow rate Q1 of the first hydraulic pump 31, a discharge flow rate Q2 of the second hydraulic pump 32, a setting value of the throttle dial 33, and a work mode selected via the work mode selector 34 in the separated state (step SP1).

As described above, an upper limit engine speed Nmax of the engine 4 is set on the basis of the setting value of the throttle dial 33. Additionally, maximum output of the engine 4 is set on the basis of the work mode.

Figure 13:
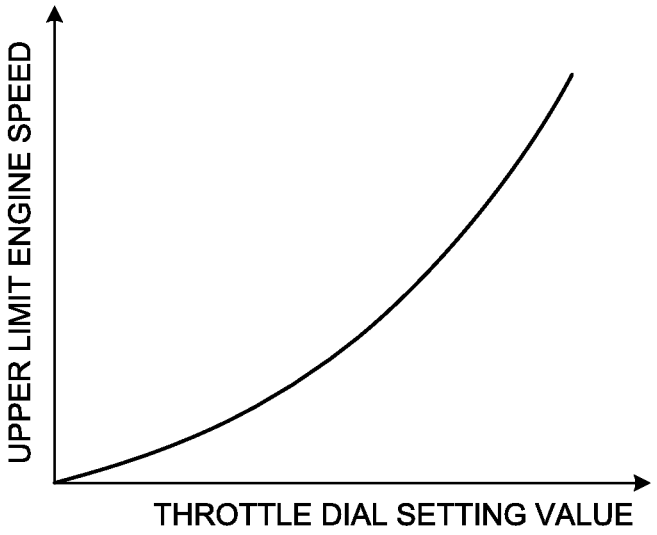
FIG. 13 is a diagram illustrating exemplary fourth correlation data indicating a relation between a setting value of a throttle dial and an upper limit engine speed of the engine according to the present embodiment.

FIG. 13 is a diagram illustrating exemplary fourth correlation data illustrating a relation between the setting value of the throttle dial 33 and the upper limit engine speed Nmax of the engine 4 according to the present embodiment. In a graph illustrated in FIG. 13, an horizontal axis represents the setting value of the throttle dial 33, and a vertical axis represents the upper limit engine speed Nmax of the engine 4. The fourth correlation data is known data and stored in the storage unit 144.

As illustrated in FIG. 13, the upper limit engine speed Nmax of the engine 4 is varied on the basis of the setting value of the throttle dial 33. The setting value of the throttle dial 33 corresponds one-to-one with the upper limit engine speed Nmax of the engine 4. An operator can adjust the upper limit engine speed Nmax of the engine 4 by operating the throttle dial 33.

Figure 14:
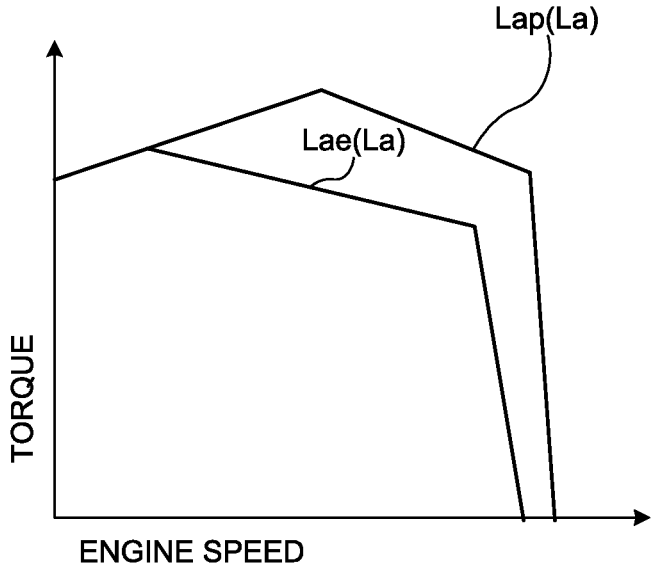
FIG. 14 is a diagram illustrating exemplary fifth correlation data indicating a relation between a work mode and maximum output of the engine according to the present embodiment.

FIG. 14 is a diagram illustrating exemplary fifth correlation data illustrating a relation between the work mode and maximum output of the engine 4 according to the present embodiment. In the graph illustrated in FIG. 14, a horizontal axis represents an engine speed of the engine 4, and a vertical axis represents torque of the engine 4.

In the present embodiment, an operator can select either a first work mode (P mode) or a second work mode (E mode) by operating the work mode selector 34. By selecting the work mode, an upper limit torque characteristic of the engine 4 indicated by the maximum output torque line La is changed. As illustrated in FIG. 14, in the present embodiment, when the first work mode is selected, the upper limit torque characteristic of the engine 4 is defined by a maximum output torque line Lap. When the second work mode is selected, the upper limit torque characteristic of the engine 4 is defined by a maximum output torque line Lae. Since the upper limit torque characteristic of the engine 4 is changed, the maximum output of the engine 4 is changed. The fifth correlation data indicating the relation between the work mode selected by the work mode selector 34 and the maximum output (maximum output torque) of the engine 4 is known data and stored in the storage unit 145. An operator can adjust the maximum output of the engine 4 by operating the work mode selector 34.

As illustrated in FIG. 12, the filter processing unit 132 determines whether to apply filter processing to the operation amount S of the operation device 5 after acquiring the operation amount S, discharge pressure P1, discharge pressure P2, discharge flow rate Q1, discharge flow rate Q2, setting value of the throttle dial 33, and work mode selected via the work mode selector 34 (step SP2).

In the present embodiment, when the operation speed of the operation device 5 is the prescribed value or more, the filter processing is applied to the operation amount S of the operation device 5. When the operation speed of the operation device 5 is lower than the prescribed value, the filter processing is not applied to the operation amount S of the operation device 5. The prescribed value is a predetermined value and stored in the storage unit 146. In other words, in the present embodiment, when the operation device 5 is operated at a high speed, the filter processing is applied to the operation amount S. When the operation device 5 is operated at a low speed, the filter processing is not applied to the operation amount S.

In the case of determining to apply the filter processing in step SP2 (step SP2: Yes), the filter processing unit 132 applies the filter processing to the operation amount S of the operation device 5 (step SP3). In the present embodiment, the filter processing unit 132 applies primary low-pass filter processing to the operation amount S. Furthermore, the higher the operation speed of the operation device 5 is, the larger time constant the filter processing unit 132 sets for the primary low-pass filter processing.

On the other hand, in the case of determining not to apply the filter processing in step SP2 (step SP2: No), the filter processing is not applied to the operation amount S of the operation device 5, and the processing proceeds to a next step.

The control device 100 determines an excessive output Ws of the engine 4 in accordance with the processing SA described with reference to FIG. 5 (step SP4).

Additionally, the control device 100 determines a target output Wr of the engine 4 in accordance with the processing SB described with reference to FIG. 6 (step SP5).

Furthermore, the control device 100 calculates the lower limit engine speed Nmin of the engine 4 in accordance with the processing SD described with reference to FIG. 8 (step SP6).

After the excessive output Ws is determined in step SP4 and the target output Wr is determined in step SP5, the control device 100 calculates a reduced output Wc of the engine 4 in accordance with the processing SC described with reference to FIG. 7 (step SP7).

The control device 100 calculates a target engine speed Nr of the engine 4 in the separated state on the basis of the reduced output Wc of the engine 4 calculated in step SP7 and the third correlation data stored in the storage unit 143 (step SP8).

The control device 100 selects a higher engine speed out of the target engine speed Nr and the lower limit engine speed Nmin by comparing the target engine speed Nr of the engine 4 calculated in the target engine speed calculation unit 128 with the lower limit engine speed Nmin calculated in the lower limit engine speed setting unit 130. The control device 100 determines a target matching engine speed of the engine 4 and the hydraulic pump 30 on the basis of the selected engine speed (step SP9).

Figure 15:
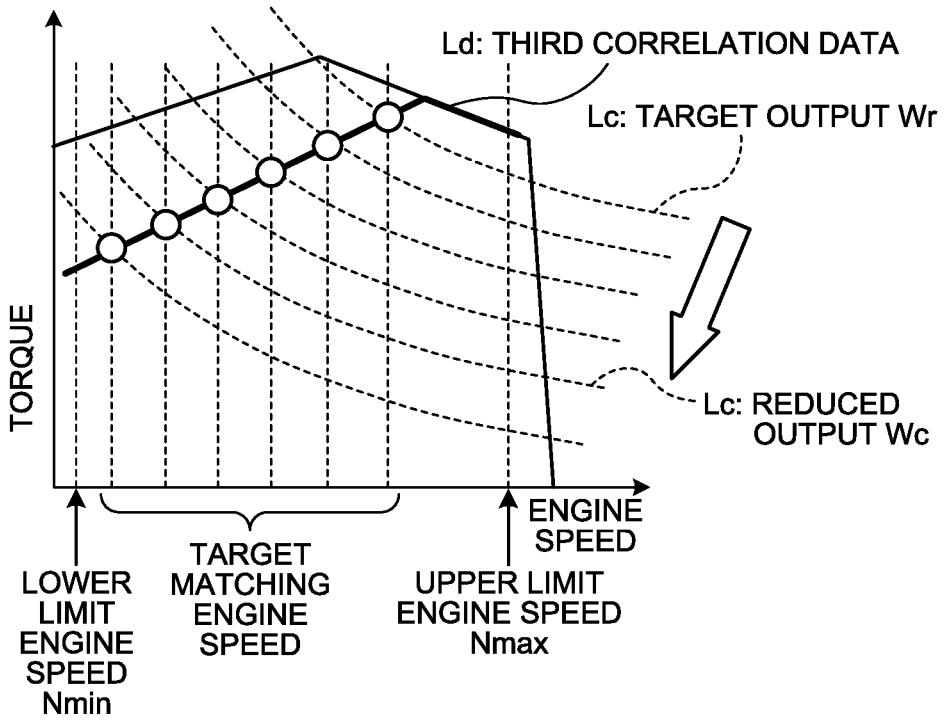
FIG. 15 is a view illustrating exemplary third correlation data according to the present embodiment.

FIG. 15 is a diagram illustrating exemplary third correlation data according to the present embodiment. In a graph illustrated in FIG. 15, a horizontal axis represents an engine speed of the engine 4, and a vertical axis represents torque of the engine 4. As described above, the third correlation data is known data indicating the relation between output of the engine 4 and an engine speed of the engine 4 and stored in the storage unit 143.

In FIG. 15, an equal output line Lc defines the reduced output Wc that is the engine target output according to the present embodiment. The larger the excessive output Ws is, the smaller the reduced output Wc indicated by the equal output line Lc is as indicated by an arrow in FIG. 15.

The control device 100 determines a target matching engine speed of the engine 4 and the hydraulic pump 30 in the separated state on the basis of the reduced output Wc (equal output line Lc) calculated in the reduced output calculation unit 126 and the third correlation data stored in the storage unit 143. In the example illustrated in FIG. 15, the target matching engine speed is determined on the basis of an intersection point of the equal output line Lc with a line Ld indicating the third correlation data.

The control device 100 controls the engine 4 such that the engine 4 is driven at the target matching engine speed set between the upper limit engine speed Nmax and the lower limit engine speed Nmin (step SP10).

[Effects]

As described above, according to the present embodiment, the merging flow path 55 that connects the first hydraulic pump 31 to the second hydraulic pump 32 is switched between the separated state and the merged state by the first merging-separating valve 67. When the hydraulic circuit 40 is in the separated state, the excessive output Ws is calculated on the basis of: the merged-state pump output Wa indicating output of the hydraulic pump 30 on the assumption of the merged state; and the separated-state pump output Wb indicating output of the hydraulic pump 30 at the time of the separated state. The target output Wr is reduced on the basis of the excessive output Ws, and the reduced output Wc that is the final target output is calculated. In the separated state, since the engine 4 is driven on the basis of the reduced output Wc, the engine 4 is prevented from being driven with unnecessarily high output. Therefore, fuel consumption of the engine 4 is reduced.

Furthermore, in the present embodiment, the relation of [Wa=Wa1+Wa2] is established among the merged-state pump output Wa, output Wa1 of the first hydraulic pump 31 required in the merged state, and output Wa2 of the second hydraulic pump 32 required in the merged state. The relation of [Wb=Wb1+Wb2] is established among the separated-state pump output Wb, output Wb1 of the first hydraulic pump 31 required in the separated state, and output Wb2 of the second hydraulic pump 32 required in the separated state. The relation of [Ws=Wa−Wb] is established among the excessive output Ws, merged-state pump output Wa, and separated-state pump output Wb. The relation of [Wc=Wr−Ws] is established among the target output Wr of the engine 4, excessive output Ws of the engine 4, and reduced output Wc of the engine 4 in the separated state. Consequently, the engine 4 is driven with the necessarily sufficient output, and the work unit 10 can be smoothly actuated while reducing the fuel consumption of the engine 4.

Furthermore, in the present embodiment, the relationship of [Wa≈Pmax×Q1+Pmax×Q2] is established among the merged-state pump output Wa, discharge pressure Pmax, discharge flow rate Q1, and discharge flow rate Q2. Meanwhile, the discharge pressure Pmax is the higher discharge pressure out of the discharge pressure P1 and the discharge pressure P2. Additionally, the relation of [Wb≈P1×Q1+P2×Q2] is established among the separated-state pump output Wb, discharge pressure P1, discharge pressure P2, discharge flow rate Q1, and discharge flow rate Q2. Consequently, appropriate excessive output Ws can be calculated on the basis of the merged-state pump output Wa and the separated-state pump output Wb.

Furthermore, in the present embodiment, the lower limit engine speed Nmin of the engine 4 at which the separated state can be kept is set. The engine control unit 134 controls the engine 4 such that the engine 4 is driven at an engine speed of the lower limit engine speed Nmin or more. Consequently, a state in which the hydraulic circuit 40 is in the separated state is kept for a long period, and the fuel consumption of the engine 4 is improved.

Moreover, in the present embodiment, the operation amount S of the operation device 5 used to calculate the distribution flow rate Qa is applied with the filter processing. In the case where the distribution flow rate Qa is calculated on the basis of the operation amount S that is rapidly changed when an operation speed of the operation device 5 is high, the excessive output Ws, reduced output Wc, lower limit engine speed Nmin, and the like calculated on the basis of the distribution flow rate Qa are also rapidly changed, and there may be possibility that smooth actuation of the work unit 10 is hindered. In the present embodiment, when the operation speed of the operation device 5 is a high speed that is the prescribed value or more, the filter processing is applied to the operation amount S. Consequently, a delay is generated in the operation amount S, and therefore, rapid change of the distribution flow rate Qa and rapid change of the excessive output Ws, reduced output Wc, lower limit engine speed Nmin, and the like calculated on the basis of the distribution flow rate Qa are suppressed. Therefore, the work unit 10 can be actuated smoothly.

Meanwhile, in the above embodiment, it is assumed that the hydraulic pump 30 is a swash plate hydraulic pump. The hydraulic pump 30 may not necessarily be the swash plate hydraulic pump. Also, the hydraulic pump 30 may not necessarily a variable displacement hydraulic pump, but may also be a fixed displacement hydraulic pump.

Meanwhile, in the above embodiment, it is assumed that the pressure PLbk, pressure PLar, and pressure PLbm are pressures of the bucket cylinder 21, pressure of the arm cylinder 22, and pressure of the boom cylinder 23. For example, a pressure of the bucket cylinder 21, a pressure of the arm cylinder 22, and a pressure of the boom cylinder 23 which are corrected by, for example, an area ratio of the throttle valves included in the pressure compensating valves 71 to 76 may be set as the pressure PLbk, pressure PLar, and pressure PLbm.

Meanwhile, in the above embodiment, it is assumed that the threshold value Qs used to determine whether to actuate the first merging-separating valve 67 is the maximum discharge flow rate Qmax. The threshold value Qs may also be a value smaller than the maximum discharge flow rate Qmax.

Meanwhile, in the above embodiment, it is assumed that the work machine 1 is the excavator 1 of the hybrid system. The work machine 1 may not necessarily be the excavator 1 of the hybrid system. In the above-described embodiment, it is assumed that the upper swing body 2 is swung by the electric motor 25, but may also be swung by a hydraulic motor. The hydraulic motor may calculate a distribution flow rate and pump output by including a swing motor in either the first hydraulic actuator or the second hydraulic actuator.

Meanwhile, in the above embodiment, it is assumed that the control system 1000 is applied to the excavator 1. The work machine to which the control system 1000 is applied is not limited to the excavator 1, and the control system can be widely applied to hydraulically driven work machines other than the excavator.

REFERENCE SIGNS LIST

1 EXCAVATOR (WORK MACHINE)
2 UPPER SWING BODY
3 LOWER TRAVELING BODY
4 ENGINE
4R ENGINE SPEED SENSOR
4S OUTPUT SHAFT
5 OPERATION DEVICE
5L LEFT OPERATING LEVER
5R RIGHT OPERATING LEVER
6 OPERATING ROOM
6S OPERATOR'S SEAT
7 MACHINE ROOM
8 CRAWLER
10 WORK UNIT
11 BUCKET
12 ARM
13 BOOM
14 STORAGE BATTERY
14C TRANSFORMER
15G FIRST INVERTER
15R SECOND INVERTER
16 ROTATION SENSOR
20 HYDRAULIC CYLINDER
21 BUCKET CYLINDER
21A FIRST BUCKET FLOW PATH
21B SECOND BUCKET FLOW PATH
21C CAP-SIDE SPACE
21L ROD-SIDE SPACE
22 ARM CYLINDER
22A FIRST ARM FLOW PATH
22B SECOND ARM FLOW PATH
22C CAP-SIDE SPACE
22L ROD-SIDE SPACE
23 BOOM CYLINDER
23A FIRST BOOM FLOW PATH
23B SECOND BOOM FLOW PATH
23C CAP-SIDE SPACE
23L ROD-SIDE SPACE
24 HYDRAULIC MOTOR
25 ELECTRIC MOTOR
27 GENERATOR MOTOR
29 COMMON RAIL CONTROL UNIT
30 HYDRAULIC PUMP
30A SWASH PLATE
30B SERVO MECHANISM
30S SWASH PLATE ANGLE SENSOR
31 FIRST HYDRAULIC PUMP
31A SWASH PLATE
31B SERVO MECHANISM
31S SWASH PLATE ANGLE SENSOR
32 SECOND HYDRAULIC PUMP
32A SWASH PLATE
32B SERVO MECHANISM
32S SWASH PLATE ANGLE SENSOR
33 THROTTLE DIAL
34 WORK MODE SELECTOR
40 HYDRAULIC CIRCUIT
41 FIRST HYDRAULIC PUMP FLOW PATH
42 SECOND HYDRAULIC PUMP FLOW PATH
43 FIRST SUPPLY FLOW PATH
44 SECOND SUPPLY FLOW PATH
45 THIRD SUPPLY FLOW PATH
46 FOURTH SUPPLY FLOW PATH
47 FIRST BRANCH FLOW PATH
48 SECOND BRANCH FLOW PATH
49 THIRD BRANCH FLOW PATH
50 FOURTH BRANCH FLOW PATH
51 FIFTH BRANCH FLOW PATH
52 SIXTH BRANCH FLOW PATH
53 DISCHARGE FLOW PATH
54 TANK
55 MERGING FLOW PATH (FLOW PATH)
60 MAIN OPERATION VALVE
61 FIRST MAIN OPERATION VALVE
62 SECOND MAIN OPERATION VALVE
63 THIRD MAIN OPERATION VALVE
67 FIRST MERGING-SEPARATING VALVE
68 SECOND MERGING-SEPARATING VALVE
69 UNLOAD VALVE
70 PRESSURE COMPENSATING VALVE
71 PRESSURE COMPENSATING VALVE
72 PRESSURE COMPENSATING VALVE
73 PRESSURE COMPENSATING VALVE
74 PRESSURE COMPENSATING VALVE
75 PRESSURE COMPENSATING VALVE
76 PRESSURE COMPENSATING VALVE
80 LOAD PRESSURE SENSOR
81 BUCKET LOAD PRESSURE SENSOR
81C BUCKET LOAD PRESSURE SENSOR
81L BUCKET LOAD PRESSURE SENSOR
82 ARM LOAD PRESSURE SENSOR
82C ARM LOAD PRESSURE SENSOR
82L ARM LOAD PRESSURE SENSOR
83 BOOM LOAD PRESSURE SENSOR
83C BOOM LOAD PRESSURE SENSOR
83L BOOM LOAD PRESSURE SENSOR
90 OPERATION AMOUNT SENSOR
91 BUCKET OPERATION AMOUNT SENSOR
92 ARM OPERATION AMOUNT SENSOR
93 BOOM OPERATION AMOUNT SENSOR
100 CONTROLLER
100A PUMP CONTROLLER
100B HYBRID CONTROLLER
100C ENGINE CONTROLLER
101 ARITHMETIC PROCESSING DEVICE
102 STORAGE DEVICE
103 INPUT/OUTPUT INTERFACE DEVICE
112 DISTRIBUTION FLOW RATE CALCULATION UNIT
114 SWITCHING DEVICE CONTROL UNIT
116 PUMP FLOW RATE CALCULATION UNIT
118 MERGED-STATE PUMP OUTPUT CALCULATION UNIT
120 SEPARATED-STATE PUMP OUTPUT CALCULATION UNIT
122 EXCESSIVE OUTPUT CALCULATION UNIT

124 TARGET OUTPUT CALCULATION UNIT
126 REDUCED OUTPUT CALCULATION UNIT
128 TARGET ENGINE SPEED CALCULATION UNIT
130 LOWER LIMIT ENGINE SPEED SETTING UNIT
132 FILTER PROCESSING UNIT
134 ENGINE CONTROL UNIT
141 STORAGE UNIT
142 STORAGE UNIT
143 STORAGE UNIT
144 STORAGE UNIT
145 STORAGE UNIT
146 STORAGE UNIT
701 SHUTTLE VALVE
702 SHUTTLE VALVE
800 DISCHARGE PRESSURE SENSOR
801 DISCHARGE PRESSURE SENSOR
802 DISCHARGE PRESSURE SENSOR
1000 CONTROL SYSTEM
1000A HYDRAULIC SYSTEM
1000B ELECTRIC SYSTEM
Br1 FIRST BRANCH PORTION
Br2 SECOND BRANCH PORTION
Br3 THIRD BRANCH PORTION
Br4 FOURTH BRANCH PORTION
Q DISCHARGE FLOW RATE
Q1 DISCHARGE FLOW RATE
Q2 DISCHARGE FLOW RATE
Qa DISTRIBUTION FLOW RATE
Qabk DISTRIBUTION FLOW RATE
Qaar DISTRIBUTION FLOW RATE
Qabm DISTRIBUTION FLOW RATE
P DISCHARGE PRESSURE
P1 DISCHARGE PRESSURE
P2 DISCHARGE PRESSURE
PL PRESSURE
PLbk PRESSURE
PLar PRESSURE
PLbm PRESSURE
Qs THRESHOLD
RX SWING SHAFT

The invention claimed is:

1. A control system, comprising:

an engine;

a first hydraulic pump and a second hydraulic pump driven by the engine;

a switching device provided in a flow path that connects the first hydraulic pump to the second hydraulic pump, and configured to perform switching between a merged state in which the flow path is opened and a separated state in which the flow path is closed;

a first hydraulic actuator to which hydraulic fluid discharged from the first hydraulic pump is supplied in the separated state;

a second hydraulic actuator to which hydraulic fluid discharged from the second hydraulic pump is supplied in the separated state;

a distribution flow rate calculation unit configured to calculate a distribution flow rate of the hydraulic fluid to be supplied to each of the first hydraulic actuator and the second hydraulic actuator on the basis of a pressure of hydraulic fluid in each of the first hydraulic actuator and the second hydraulic actuator and an operation amount of an operation device operated in order to drive each of the first hydraulic actuator and the second hydraulic actuator;

a merged-state pump output calculation unit configured to calculate merged-state pump output indicating output of the first hydraulic pump and output of the second hydraulic pump required in the merged state on the basis of the distribution flow rate;

a separated-state pump output calculation unit configured to calculate separated-state pump output indicating output of the first hydraulic pump and output of the second hydraulic pump required in the separated state on the basis of the distribution flow rate;

an excessive output calculation unit configured to calculate excessive output of the engine on the basis of the merged-state pump output and the separated-state pump output;

a reduced output calculation unit configured to calculate reduced output of the engine more reduced than a target output of the engine by correcting the target output of the engine on the basis of the excessive output; and an engine control unit configured to control the engine on the basis of the reduced output in the separated state.

2. The control system according to claim 1, wherein the merged-state pump output includes a sum of output of the first hydraulic pump and output of the second hydraulic pump required in the merged state, the separated-state pump output includes a sum of output of the first hydraulic pump and output of the second hydraulic pump required in the separated state, and the excessive output includes a difference between the merged-state pump output and the separated-state pump output.

3. The control system according to claim 1, further comprising a pump flow rate calculation unit configured to calculate, on the basis of the distribution flow rate, each of a discharge flow rate of the hydraulic fluid discharged from the first hydraulic pump and a discharge flow rate of the hydraulic fluid discharged from the second hydraulic pump in the separated state, wherein the merged-state pump output calculation unit calculates the merged-state pump output on the basis of: a higher discharge pressure out of a discharge pressure of the hydraulic fluid discharged from the first hydraulic pump and a discharge pressure of the hydraulic fluid discharged from the second hydraulic pump in the separated state; the discharge flow rate of the hydraulic fluid discharged from the first hydraulic pump in the separated state; and the discharge flow rate of the hydraulic fluid discharged from the second hydraulic pump in the separated state, and the separated-state pump output calculation unit calculates the separated-state pump output on the basis of: the discharge pressure and the discharge flow rate of the hydraulic fluid discharged from the first hydraulic pump in the separated state; and the discharge pressure and the discharge flow rate of the hydraulic fluid discharged from the second hydraulic pump in the separated state.

4. The control system according to claim 1, further comprising a target output calculation unit configured to calculate the target output of the engine on the basis of: an operation amount of the operation device; a discharge pressure of the hydraulic fluid discharged from the first hydraulic pump; and a discharge pressure of the hydraulic fluid discharged from the second hydraulic pump.

5. The control system according to claim 1, further comprising a lower limit engine speed setting unit configured to set a lower limit engine speed indicating a lower limit value of an engine speed of the engine such that the hydraulic fluid is supplied to each of the first hydraulic actuator and the second hydraulic actuator at the distribution flow rate in the separated state, wherein the engine control unit controls the engine such that the engine is driven at an engine speed of the lower limit engine speed or more.

6. The control system according to claim 5, further comprising a switching device control unit configured to control the switching device so as to perform switching to any one of the merged state and the separated state on the basis of a comparison result between the distribution flow rate and a maximum discharge flow rate of the hydraulic fluid that can be discharged by each of the first hydraulic pump and the second hydraulic pump, wherein an engine speed of the engine equal to or more than the lower limit engine speed is an engine speed of the engine at which the separated state is kept.

7. The control system according to claim 5, further comprising:

a storage unit configured to store correlation data indicating a relation between output of the engine and an engine speed of the engine; and a target engine speed calculation unit configured to calculate a target engine speed of the engine in the separated state on the basis of the target output of the engine and the correlation data, wherein the engine control unit controls the engine such that the engine is driven at a higher engine speed out of the target engine speed and the lower limit engine speed.

8. The control system according to claim 1, further comprising a filter processing unit configured to apply filter processing to an operation amount of the operation device when an operation speed of the operation device is a prescribed value or more in the separated state, wherein the distribution flow rate calculation unit calculates the distribution flow rate of the hydraulic fluid supplied to each of the first hydraulic actuator and the second hydraulic actuator on the basis of the operation amount of the operation device that has been applied with the filter processing.

9. A work machine comprising a control system according to claim 1.

* * * * *